US007986506B2

(12) United States Patent
Brundula

(10) Patent No.: US 7,986,506 B2
(45) Date of Patent: Jul. 26, 2011

(54) SYSTEMS AND METHODS FOR ARC ENERGY REGULATION AND PULSE DELIVERY

(75) Inventor: Steven N. D. Brundula, Chandler, AZ (US)

(73) Assignee: TASER International, Inc., Scottsdale, AZ (US)

( * ) Notice: Subject to any disclaimer, the term of this patent is extended or adjusted under 35 U.S.C. 154(b) by 389 days.

(21) Appl. No.: 11/943,467

(22) Filed: Nov. 20, 2007

(65) Prior Publication Data

US 2008/0158769 A1 Jul. 3, 2008

Related U.S. Application Data

(63) Continuation-in-part of application No. 11/381,454, filed on May 3, 2006, now Pat. No. 7,457,096, and a continuation-in-part of application No. 11/737,374, filed on Apr. 19, 2007, now Pat. No. 7,821,766.

(51) Int. Cl.
*F41C 9/00* (2006.01)

(52) U.S. Cl. ..... 361/232; 42/1.08

(58) Field of Classification Search ..... 361/232; 42/1.08; 102/502

See application file for complete search history.

(56) References Cited

U.S. PATENT DOCUMENTS 2,014,367 A 9/1935 Breegle
3,089,420 A 5/1963 Littleford
3,404,598 A 10/1968 Angelos
3,699,388 A 10/1972 Ukai
4,478,150 A 10/1984 Sayler
4,582,063 A 4/1986 Mickiewicz
4,644,439 A 2/1987 Taarning
4,938,146 A 7/1990 Gunther
4,943,885 A 7/1990 Willoughby
5,067,495 A 11/1991 Brehm
5,086,703 A 2/1992 Klein
5,124,905 A 6/1992 Kniepkamp
5,193,048 A 3/1993 Kaufman
5,215,066 A 6/1993 Narishige
5,304,211 A 4/1994 Israel
5,309,842 A 5/1994 Matysik
5,317,155 A 5/1994 King
5,350,415 A 9/1994 Cywinski
5,457,597 A 10/1995 Rothschild
5,473,501 A 12/1995 Claypool
5,625,525 A 4/1997 Coakley
5,675,103 A 10/1997 Herr
5,750,918 A 5/1998 Mangolds
5,800,461 A * 9/1998 Menken et al. ..... 607/7
5,801,617 A 9/1998 Langner (Continued)

*Primary Examiner* — Danny Nguyen
(74) *Attorney, Agent, or Firm* — William R. Bachand

(57) ABSTRACT

An apparatus for interfering with locomotion of a target by conducting a current through a load that includes an ionizable path. The apparatus includes, according to various aspects of the present invention, an energy source, an ionization detector, a charge detector, a controller, and a pulse generator. The controller determines, in response to the detector and by trial and error, a respective quantity of energy for each pulse of a plurality of pulses to be generated. For each pulse of the plurality, the pulse generator receives the respective quantity of energy from the energy source, provides in response to the quantity of energy a respective voltage to ionize the ionization path, and provides the current through the load. The charge detector detects a charge provided through the load. The processor sets the voltage for charging for a next pulse in response to the charge detected by the charge detector.

49 Claims, 7 Drawing Sheets

U.S. PATENT DOCUMENTS

| | | | |
|---|---|---|---|
| 5,834,681 | A | 11/1998 | DuBay |
| 5,891,172 | A | 4/1999 | Stendahl |
| 5,936,183 | A | 8/1999 | McNulty |
| 5,962,806 | A | 10/1999 | Coakley |
| 5,988,036 | A | 11/1999 | Mangolds |
| 6,493,588 | B1 | 12/2002 | Malaney |
| 6,575,073 | B2 | 6/2003 | McNulty, Jr. |
| 6,636,412 | B2 | 10/2003 | Smith |
| 6,937,455 | B2 | 8/2005 | Krichtafovitch |
| 6,999,295 | B2 | 2/2006 | Watkins |
| 7,057,872 | B2 | 6/2006 | Smith |
| 7,075,770 | B1 | 7/2006 | Smith |
| 7,102,870 | B2 | 9/2006 | Nerheim |
| 7,158,362 | B2 | 1/2007 | Smith |
| 7,234,262 | B2 | 6/2007 | Smith |
| 7,280,340 | B2 | 10/2007 | Smith |
| 7,457,096 | B2 | 11/2008 | Brundula |
| 7,613,017 | B1 * | 11/2009 | Diana et al. ..... 363/20 |
| 7,778,004 | B2 | 8/2010 | Nerheim |

* cited by examiner

800

TABLE OF CONDITIONS

| | CHARGE DETECTED THIS PULSE | ADJUSTMENT FOR NEXT PULSE |
|---|---|---|
| 802 | NO ARC FORMED (E.G., LESS THAN THRESHHOLD AMOUNT) | NO CHANGE TO ENERGY STORED |
| 804 | UNDER GOAL (E.G., ABOUT B) | INCREASE ENERGY STORED TO INCREASE CHARGE DELIVERED TO TARGET |
| 806 | AT GOAL (E.G., ABOUT B+C) | REPEAT ENERGY STORED AT EXISTING AMOUNT |
| 808 | OVER GOAL (E.G., B+C+D) | DECREASE ENERGY STORED TO DECREASE CHARGE DELIVERED TO TARGET |

*FIG. 8*

SYSTEMS AND METHODS FOR ARC ENERGY REGULATION AND PULSE DELIVERY

CROSS REFERENCE TO RELATED APPLICATION

This application is a Continuation-In-Part of and claims priority under 35 U.S.C. §120 from U.S. patent application Ser. No. 11/381,454 by Brundula, filed May 3, 2006 now U.S. Pat. No. 7,457,096, and is a Continuation-In-Part of and claims priority under 35 U.S.C. §120 from U.S. patent application Ser. No. 11/737,374 by Brundula, filed Apr. 19, 2007 now U.S. Pat. No. 7,821,766.

FIELD OF THE INVENTION

Embodiments of the present invention relate to systems and methods for providing pulses from an electronic weapon.

BACKGROUND

An electric arc formed between a pair of conductors that are separated by an otherwise insulating gas may be designed to provide light, heat, sound, or radio frequency signals. By providing heat, the arc may be used to ignite the gas, for example for producing light, heat, or propulsion. In other applications for an electric arc, the arc may be designed to complete a circuit for current to flow through the arc and through a load. A circuit that causes an arc to form and thereafter supplies a current through the load is a drive circuit, as opposed to merely an igniter circuit, in part because it impresses across the conductors a voltage high enough to cause ionization of the gas and then provides a current through the arc and through the load. Prior to ionization, the insulating effect of the gas prevents current from flowing through the load. After ionization, the arc offers little resistance to current flow. An arc may be extinguished by reducing current flow through the arc to less than a current sufficient to maintain the arc or by increasing the insulating effect between the conductors (e.g., further separating the conductors, introducing matter between the electrodes of greater insulating effect, or removing ionized matter). With appropriate control circuits in the apparatus, the arc may perform a function of a switch to enable or disable current flow through the load.

After ionization, while the apparatus provides the current through the load, the load may change. Accordingly, the current provided to the load is somewhat non-uniform over a series of pulses intended to be uniform from one load to another or from one apparatus to another of a common type.

A conventional driver for a load that is isolated in the absence of an arc generally provides a fixed and relatively large amount of energy to assure ionization. There remains a need for an apparatus and methods performed by an apparatus that supplies an efficient amount of energy for ionization. There is a further need for an apparatus and methods performed by an apparatus that supplies an efficient amount of energy for ionization that may vary to meet changes from time to time in the insulating effect between the conductors. For example, the relatively large amount of energy expended for an ionization in a conventional igniter may be based on a theoretical maximum distance between the conductors. In other applications of igniters and drivers, the distance between the conductors may vary greatly. Using a fixed maximum amount of energy for every ionization can lead only to inefficient waste of energy for some ionization events.

It may be desirable to use as little energy as possible to overcome the insulating effect of the separation between the conductors, for example, so that a limited source of energy is conserved for completing the purposes of the current through the load.

After establishing a circuit through the load, it may be desirable in some applications to increase uniformity of pulses experienced by a load, for example, to provide a more accurate record of current delivered, to use minimum energy to provide a desired result, and to conserve energy expended by the apparatus as a whole. Conventional electronic weapons provide a stimulus signal as a series of pulses to a load. An amount of charge delivered by each pulse of the stimulus signal varies within manufacturing tolerances of the weapon and varies for a wide variety of loads that may be presented to the weapon. The load may change during stimulation. Accordingly, stimulus to the load is somewhat non-uniform over a series of pulses intended to be uniform from one load to another or from one weapon to another of a common type. Unless energy is conserved, the period of time an electrical weapon is available for use cannot be extended. Battery powered applications are among those applications having a limited source of energy.

Implementations according to various aspects of the present invention solve the problems discussed above and other problems, and provide the benefits discussed above and other benefits as will be apparent to a skilled artisan in light of the disclosure of invention made herein.

SUMMARY

A method is performed by an apparatus for interfering with voluntary locomotion by a target by conducting a current through the target. The method includes in any practical order: (a) monitoring the current delivered through the target, wherein the current causes pain or skeletal muscle contractions that interfere with voluntary locomotion by the target; and (b) adjusting the current in response to a result of monitoring.

An apparatus interferes with voluntary locomotion of a target by conducting a current through the target. The apparatus includes a current delivery circuit, a detector, and a processor. The current delivery circuit delivers the current for causing pain or skeletal muscle contractions that interfere with voluntary locomotion by the target. The detector detects the current delivered through the target. The processor adjusts the current responsive to a result of the detector.

BRIEF DESCRIPTION OF THE DRAWING

Embodiments of the present invention will now be further described with reference to the drawing, wherein like designations denote like elements, and:

FIG. 8 is a table of conditions detected and adjustments made by the method of FIG. 7.

DETAILED DESCRIPTION OF THE PREFERRED EMBODIMENTS

Figure 1:
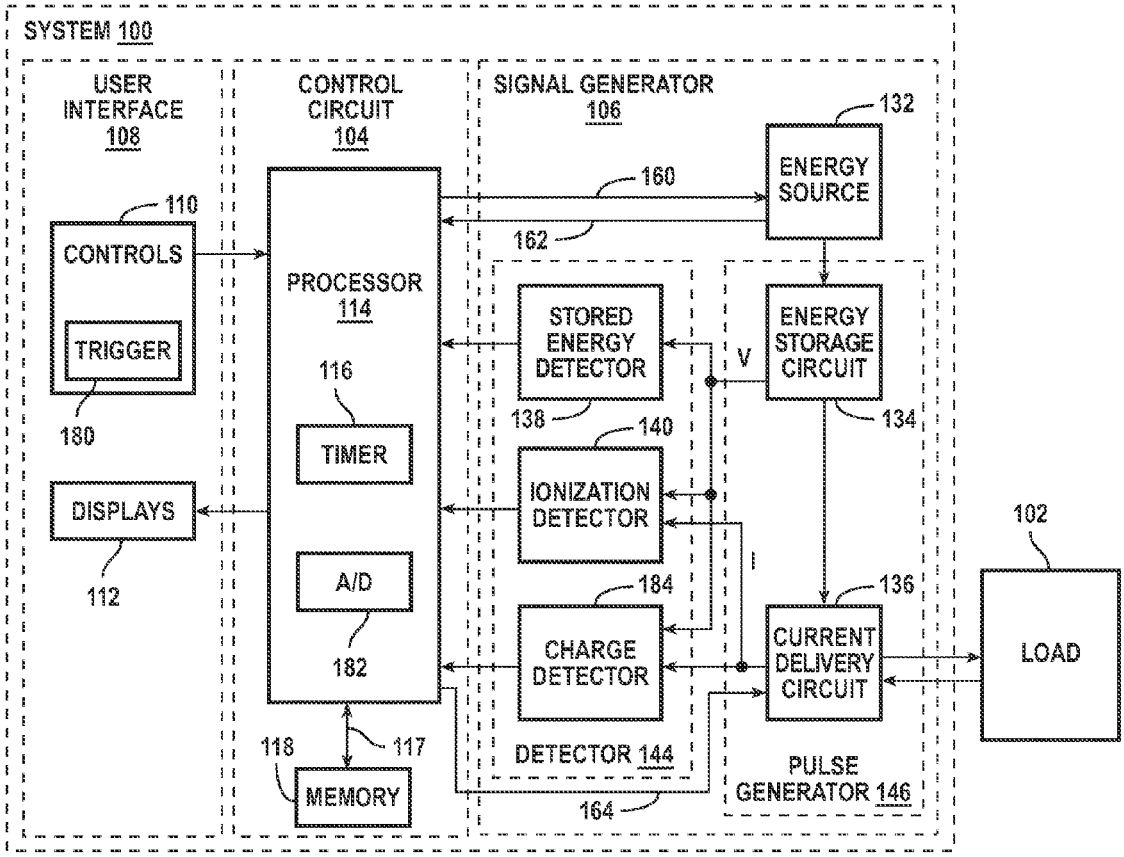
FIG. 1 is a functional block diagram of an apparatus for driving an isolated load, according to various aspects of the present invention.

To provide a current through a load, a circuit must exist through the load. Ionization may be necessary to form such a circuit. The circuit exists while ionization is maintained. A relatively high voltage is generally required from an apparatus to accomplish ionization of a particular path. When the load presents a relatively low impedance to the apparatus, the relatively high voltage of the apparatus impressed across the relatively low impedance of the load may cause a relatively high power to be dissipated in the ionized path and the load. When the insulating properties of the path vary, a lower voltage may be sufficient to accomplish ionization. Using the relatively high voltage when a lower voltage may be sufficient contributes to unnecessary power consumption. Power consumption may be reduced according to various aspects of the present invention.

Once a circuit exists through a load (e.g., path formed), a current may be delivered through the load. Effective delivery of current through a load may depend on a degree of matching between an impedance of the delivery circuit and an impedance of the load. Delivery circuit impedance may vary within manufacturing tolerances and the circuit's components. Load impedance may depend on the type of load, environmental conditions, and/or circuit formation from the delivery circuit of the apparatus through the load.

Applications for driver apparatus according to various aspects of the present invention may include power distribution, communication, signal switching, igniters for engines and/or furnaces, signal generators, and specific applications for signal generators (e.g., for weapons such as electronic weapons). In the discussion that follows, aspects of the present invention (e.g., an apparatus or system) will be described with reference to an electronic weapon at least because power conservation may be important in such an application (e.g., a battery powered electronic weapon) and an electronic weapon conveniently illustrates providing a current through a relatively low impedance load (e.g., animal or human tissue) after ionization.

Applications of electronic weapons may generally include a local stun function where electrodes fixed to the electronic weapon (e.g., a gun or projectile) are proximate to target tissue; and a remote stun function where electrodes of the electronic weapon are launched away from the electronic weapon (e.g., connected by conducting tether wires).

Electronic weapons include any weapon that passes a current through the target, for example, a hand-held weapon (e.g., contact stun device, stun gun, baton, shield); a gun, installation, or mine that shoots wire tethered darts; a wireless projectile launched (e.g., by a hand-held gun, installation, or mine) toward the target; or a restraint device (e.g., an electrified belt, harness, collar, shackles, hand cuffs) affixed to the target. All or part of an electronic circuit that provides the current may be propelled toward the target.

An electronic weapon when used against a human or animal target causes an electric current to flow through part of the target's tissue to interfere with the target's use of its skeletal muscles. The current may be delivered as a plurality of current pulses through the target. The electric current from the current pulses causes an electric current to flow through part of the target's tissue to interfere with the target's use of its skeletal muscles.

An individual such as a police officer, a military soldier, or a private citizen may desire to interfere with the voluntary locomotion of a target. Locomotion by a target may include movement toward and/or away from the individual by all or part of the target. An individual may desire to interfere with locomotion by a target for defensive or offensive purposes (e.g., self defense, protection of others, defense of property, controlling access to an area, threat elimination).

In either a local stun or remote stun function, the electrodes of the electronic weapon may not reach target tissue, for example, when pressed against or lodged in the target's clothing. The gap between the electrode and target tissue may include various insulators (e.g., additional clothing) and/or air. Air in the gap from the electrode to target tissue may be ionized by a relatively high voltage supplied by the electronic weapon. Ionizing air in a gap from an electrode to target tissue may be necessary on any one or more of the pulses of the pulsed electric current. The length and composition of the gap may change from one pulse to the next.

An electronic weapon that interferes with locomotion of a human or animal target, according to various aspects of the present invention, may deliver a series of pulses of current through the target and may further record the date and time of delivery.

A pulse of current for stimulation, according to various aspects of the present invention, may include an electrical signal having more than one effective portion separated by portions designed to have little or no effect. An effective portion may have any suitable pulse width, pulse charge, voltage and/or current. Each effective pulse causes a contraction of skeletal muscles. Interference may include involuntary, repeated, intense, muscle contractions at a rate of 5 to 20 contractions per second. An effective rate of pulses may cause a tetanus type reaction of voluntary skeletal muscles that halts locomotion by the target.

Delivering prescribed (e.g., uniform) pulses, according to various aspects of the current invention, may improve effectiveness of halting locomotion. Effectiveness of pulse delivery depends on, inter alia, characteristics of a path for delivery (e.g., load conditions), electrical properties of components used in the apparatus, and operating conditions of the apparatus. Effectiveness of pulse delivery (e.g., each pulse being effective) may be accomplished by compensating for, inter alia, variations of load conditions, component values, and operating conditions.

Load conditions may vary according to atmospheric conditions (e.g., rain, humid, dry, hot, cold), target position, target movement, electrode (e.g., probe) placement with respect to a target, variations over time in electrode placement (e.g., target moves, electrode becomes embedded, electrode falls off target), target type (e.g., human or animal), target coverings (e.g., clothes), dimension of an air gap between an electrode and the target, and/or ionization of an air gap between an electrode and the target.

Electrical properties of components may vary according to well known factors including component type, manufacturing process, material type, age, and temperature. Some components may have properties (i.e. values) within relatively wide tolerances.

Operating conditions may include, temperature, humidity, age of weapon, battery conditions, duration of a particular use, number of pulses delivered, number of pulses delivered with ionization energy, and frequency of pulse delivery.

An electronic weapon, according to various aspects of the present invention, overcomes the problems discussed above, and in particular efficiently ionizes air in a gap to conduct a pulse of electric current through target tissue. In addition, after the instant of ionization, current is provided through the arc and through the tissue without an undesirable consumption of energy.

An apparatus according to various aspects of the present invention may include a delivery circuit for driving an isolated load. Driving the load may include providing a suitable first quantity of energy to ionize air in a gap and providing a suitable second quantity of energy for accomplishing an effect of the load (e.g., stimulating target tissue). For example, delivery of a series of pulses into the load may include ionizing air in a gap for each pulse of the series. The delivery circuit may adjust the first quantity of energy from pulse to pulse so that energy beyond an estimated amount is not wastefully expended for a next pulse of the series. The estimate may be based on results of attempts in driving the particular pulse and/or based on driving prior pulses in the series. Adjustment may affect how the first quantity of energy is prepared and/or delivered. For example, adjusting may include monitoring and/or controlling a voltage and/or a current associated with the first quantity of energy during storage and/or delivery.

A delivery circuit may adjust the second quantity of energy to deliver prescribed (e.g., uniform) pulses into a relatively wide range of load conditions, with variation of component values, and variation of operating conditions. Delivery of prescribed pulses increases the effectiveness and predictability of the effects of the pulses on the target.

According to various aspects of the present invention, an apparatus for establishing a circuit through a load and for interfering with locomotion of the target, for example system 100 of FIGS. 1-9, may ionize a path to the load and deliver prescribed (e.g., uniform) pulses into a relatively wide range of load conditions, with variation of component values, and variation of operating conditions.

An apparatus of the present invention may include a delivery circuit as discussed above. For example, system 100 of FIG. 1 constitutes a hand-held gun-type remote stun electronic weapon that delivers each pulse of a series of pulses through a load 102. During each pulse a current is conducted through load 102. Between pulses, substantially no current flows through load 102. Ionization may be necessary to establish the current for each pulse. The apparatus may provide a predetermined number of pulses per unit time by adjusting respective times between pulses to account for incomplete attempts at ionization.

Load 102 may include a human or animal target as described above in a conventional environment (e.g., accounting for clothing, weather, movement, body chemistry, and aggressiveness). Apparatus 100 may further record a date and a time of delivery (e.g., a trigger pull). A record of a trigger pull may indicate that a series of pulses was delivered. A record of delivery of a series of pulses that are compensated to correspond to one or more prescribed pulses decreases the need to record information about individual pulse characteristics to estimate the effect of a series of pulses on a target. Pulses may be prescribed by an algorithm (i.e. instructions and data stored in a memory for use by a processor or signal generator) or by data describing desired circuit configurations or electrical properties involved in pulse generation.

A prescribed pulse of current may have a duration of from about 5 microseconds to about 200 microseconds preferably from about 50 microseconds to about 150 microseconds. A prescribed series of pulses may include two or more pulses delivered at a rate of from about 10 to about 40 pulses per second. A series may continue from about 5 seconds to about 60 seconds, preferably from about 10 seconds to about 40 seconds.

As discussed above, ionization of a path in a circuit having an ionizable path permits a current to flow in the circuit. For an electronic weapon, a desirable effect on target tissue (e.g., loss of voluntary control of skeletal muscles) may be accomplished when a total charge per pulse is transferred. Electric charge in motion is electric current. Delivered charge is the integral of delivered current over time. Describing delivery of current through target tissue for a duration is electrically identical to describing delivery of a desired total charge through target tissue.

The functional blocks of FIG. 1 may be implemented as separately identifiable circuits (and/or routines) or implemented with multiple function circuitry (and/or programming) in any conventional manner.

A load having an ionizable path provides an electrical circuit after ionization of the ionizable path. The electrical circuit includes the load and the path. Prior to ionization, the load may conduct other current (e.g., for normal functions of the load) substantially without a current through the ionizable path (e.g., for additional or interfering functions). The ionizable path may be of relatively fixed electrical characteristics (e.g., a spark plug with rigidly spaced electrodes) or may be of relatively variable electrical characteristics (e.g., a range of isolations due to various electrode separations or various insulating materials between the electrodes).

An ionizable path typically includes one or more gaps. A gap may be provided by a conventional spark gap having an ionizable substance between its conductors (e.g., electrode assembly, packaged conductors, engine spark plug, engine igniter, furnace igniter, welder, display, RF radiator, switching component). A suitable gap may also arise from a change in position of conductors relative to each other. A suitable gap is one having an ionization within the current delivery circuit's capability to form a path (e.g., ionize). According to various aspects of the present invention, an apparatus is capable of driving fixed gaps of a relatively wide range of isolation characteristics and/or a gap having a relatively wide range of isolation characteristics over time. For example, load 102 includes tissue of a target separated from one or more conductors of system 100. Conductors of system 100 include each electrode as discussed above, and, for a remote stun function, one or more tether wires. Ionizable air typically occupies some or all of each separation. In FIG. 1, the functional block for load 102 includes the one or more separations. Target tissue of a typical human target presents a resistance of about 400 ohms to a waveform for stimulating skeletal muscles to halt locomotion by the target.

System 100 may include control circuit 104, signal generator 106, and user interface 108. Any conventional electronic circuit components and technology including firmware and software may be used to construct system 100. Control circuit 104 includes processor 114, and memory 118. Processor 114 includes timer 116 and analog-to-digital converter 182. Signal generator 106 includes energy source 132, detector 144, and pulse generator 146. Detector 144 includes stored energy detector 138, ionization detector 140, and charge detector 184. Pulse generator 146 includes energy storage circuit 134 and current delivery circuit 136. User interface 108 includes controls 110 and displays 112.

The functional blocks of system 100 may cooperate for closed loop control. Closed loop control includes conventional feedback control technology that effects an adjustment for a future function based, inter alia, upon an effect of a past performance of a related function. Trigger 180 may start or continue the function of any functional block in a loop (e.g., energy source, energy storage circuit, delivery circuit, ionization detector, and charge detector). Trigger 180 may start storage of a record of delivery.

A control circuit for an apparatus controls operation of the apparatus and may perform methods, according to various aspects of the present invention, to accomplish providing a current through a load. Controlling operation of an apparatus may include providing control signals to, and receiving status signals from, a signal generator. Controlling may also include interacting with a user via a user interface. For example, actions by control circuit 104 are coordinated and sequenced by processor 114 with reference to a digital timer. A timer includes any circuit for maintaining a time base, a date/time clock, and/or programmable counters that may be polled by or interrupt a processor. Timing may be accomplished with analog technology (e.g., relaxation oscillators under program on/off control). For example, timer 116 may include a crystal oscillator and counters. Timer 116 may be a discrete circuit or packaged with processor 114. Timer 116 provides a reference time base for any and all control signals provided by processor 114. Timer 116 may also keep time of day and date. Analog and/or digital technology may be used to implement the functions of a control circuit.

A processor directs attempting delivery of energy for ionization, delivery of pulses, and may direct recording of delivery. Delivery of energy for ionization and/or of current pulses may include controlling energy storage, controlling pulse formation, monitoring delivery, and adjusting operating parameters for a next attempt to delivery energy for ionization and/or for a next pulse to be delivered. For example, processor 114 cooperates with memory 118 to record delivery. Processor 114 monitors an amount of energy stored or delivered to attempt ionization to establish a path through a load. Indicia of such an amount may constitute a result of monitoring. Processor 114 monitors an amount of energy stored or delivered for each attempt to ionize a path. Processor 114 determines an adjustment to an amount of stored energy for a next attempt to provide an amount of energy for ionization. An energy for the next attempt may be: (a) the same amount of energy attempted to be delivered by a prior attempt, (b) an amount of energy greater than a failed attempt, or (c) an amount of energy less than a successful attempt (e.g., a uniform charge, a charge increased or decreased by a fixed amount or by a percentage.)

Processor 114 monitors an amount of charge delivered by a present pulse to the load. Indicia of such an amount may constitute a result of monitoring. Processor 114 determines an adjustment to an amount of stored energy for a next pulse to provide a prescribed amount of charge to be delivered by the next pulse. A charge for the next pulse may be: (a) the same charge attempted to be delivered by a prior pulse, (b) a charge sufficient to bring cumulative delivered charge to a prescribed amount, or (c) a charge relative to the charge actually delivered by the first pulse (e.g., a uniform charge, a charge increased or decreased by a fixed amount or by a percentage.) Processor 114 may diminish delivery of a pulse or series of pulses (e.g., discontinue, abort, attenuate, reduce a supply for).

A processor includes any circuit that performs a stored program. For example, processor 114 may include a conventional microprocessor, microcontroller, microsequencer, and/or signal processor. A processor may perform any control function described herein with reference to relative time, time of day, and/or digital or analog signals. Signals received by processor 114 may be in any conventional digital and/or analog format. If signals are in an analog format, processor 114 may include a suitable converter, for example, analog-to-digital converter 184.

Processor 114 operates from a program stored in memory 118. In operation, processor 114 responds to a signal from trigger 180 (e.g., trigger pull) to attempt initialization or begin or extend delivery of pulses. In response to the signal from trigger 180, processor 114 may record a delivery event in a log in memory 118. Processor 114 controls energy source 132, energy storage circuit 134, current delivery circuit 136, stored energy detector 138, ionization detector 140, and charge detector 184 as described herein and otherwise in any conventional manner.

A memory cooperates with a processor for performing any function of the processor. Memory operation includes storing program instructions retrieved and executed by the processor, and storing fixed and variable data used by the processor. For example, memory 118 primarily receives data from and provides data to processor 114. Memory 118 may also store information concerning each operation of system 100 (e.g., delivery date and time, respective goal amounts of energy for ionization and/or of charge, historical description of energy for ionization and/or charge delivery). Memory 118 may store an algorithm or data for attempting delivery of energy for ionization and prescribing a pulse or series of pulses in any conventional manner. Memory includes any conventional type of semiconductor memory including programmable memory. For example, memory 118 includes circuits for ROM, RAM, and flash memory. Memory 118 may also be implemented with semiconductor, magnetic, and/or optical memory technology. Memory 118 and processor 114 may be formed on one substrate. System 100 may include an interface 117 for external access to processor 114 and/or memory 118 for exchanging information (e.g., programs, logs, time synchronization, prescribed pulse characteristics). Access may be accomplished using any conventional interface and communication protocol (e.g., wireless, internet, cell phone).

A signal generator for an apparatus provides, in response to a control circuit, the output voltage and current of the apparatus for accomplishing the apparatus's functions with respect to the load. In addition, a signal generator may provide one or more status signals used by the control circuit for controlling the signal generator, or for informing an operator of the apparatus via a user interface. For example, signal generator 106 provides to control circuit 104 information describing the energy resources available for the capabilities of signal generator 106, information describing an attempted ionization, and information describing charge delivered. Further, signal generator 106, in response to control circuit 104, provides a pulse or a series of pulses sufficient for halting locomotion by a target, as discussed above. Signal generator 106 stores energy for one or more pulses and delivers energy from storage for each pulse of the series. When a suitable external source of energy is available for signal generation functions, an energy source may be omitted from signal generator 106. When energy conversion is not desired for signal generating functions, circuits for storing and reporting stored energy after conversion may be omitted.

An energy source provides energy to interfere with locomotion. An energy source may also provide energy to the circuits of system 100. An energy source may include any conventional circuitry for receiving, converting, and delivering energy suitable for signal generating functions. An energy source may include a battery and low voltage regulators and/or conventional power supply circuitry so that suitable voltages and currents may be supplied by the energy source to any functions of the signal generator and apparatus. An energy source may deliver energy to an energy storage circuit. For example, energy source 132 may include a battery, a relaxation oscillator, and a high voltage power supply (e.g., from about 100 volts to about 50,000 volts) operated from the battery. Energy source 132 may include a voltage conversion circuit (e.g., a power supply, a transformer, a dc-to-ac converter, a dc-to-dc converter). Energy source 132 may consist essentially of a precharged capacitor (e.g., charged before launch of an electrified projectile).

In operation, energy source 132 receives start information from processor 114 to provide energy (e.g., a pulse or series of pulses) to an energy storage circuit. For example, energy source 132 responds to control signals 160 from processor 114 and provides status signals 162 to processor 114. In response to control signals 160, energy source 132 supplies power to pulse generator 146 of signal generator 106. Power to pulse generator 146 may be converted from battery power and supplied at a relatively high voltage (e.g., 30 KHz rectified pulses of about 2000 volts peak) to facilitate storing energy in a capacitance of pulse generator 146 of relatively small physical size. The pulse repetition rate and/or peak voltage to be supplied to pulse generator 146 may be specified by control signals 160. Remaining battery capacity may be indicated by status signals 162. Processor 114 may control the magnitude, duration, and/or time separation (e.g., repetition rate) of pulses generated by pulse generator 146 by way of controlling energy source 132 (e.g., on/off control of the conversion function). Processor 114 may control pulse generator 146 in response to indicia of remaining battery capacity to avoid a brown out condition (e.g., completing an operation at less than normal magnitude or at other than normal timing).

Energy source 132 may receive an abort signal to stop operation (e.g., responsive to a safety switch) to stop supplying energy to an energy storage circuit.

Energy source 132 may receive adjustment information (e.g., control signals) from processor 114. Adjustment information may describe any aspect of energy supply. For example, adjustment information may include information to adjust any one or more of pulse width, number of pulses, pulse rate, pulse amplitude, and/or polarity.

A pulse generator delivers a signal intended to provide current to pass through a load having an ionizable path. If the signal is not sufficient for ionization of the path, then substantially no current is delivered. Conversely, if ionization is achieved, current may be delivered for the duration of ionization (e.g., the duration of the pulse). A pulse generator may provide status signals to a control circuit and/or receive control signals from a control circuit. In addition to forming pulses of voltage and/or current versus time, a pulse generator may perform energy conversion so that the current is delivered at a voltage different from the voltage of the energy supplied to it.

A pulse generator may receive one or more control signals from a control circuit so that pulse generation is responsive to any inputs and/or methods of the control circuit. For example, pulse generator 146 receives energy from energy source 132 as a series of pulses having a peak voltage of 2000 volts. Pulse generator 146 stores energy by incrementally charging one or more capacitors in an energy storage circuit 134. When an output pulse is to be delivered, pulse generator 146 delivers energy from energy storage circuit 134 at one or more voltages via a current delivery circuit 136. Pulse generator 146 may receive one or more control signals 164 from processor 114 and in response govern any aspect of energy storage and current delivery. For instance, control signals 164 may govern pulse magnitude(s), duration(s), and/or separations in time for a series of output pulses delivered to load 102. Control signals 164 may be simplified or omitted when control of energy source 132 is sufficient to govern energy storage (e.g., supplied energy is stored). Control signals 164 may be simplified or omitted when control of energy source 132 is sufficient to govern current delivery (e.g., delivery of some or all stored energy occurs after stored energy reaches a limit).

An energy storage circuit receives energy from a source and stores energy at the same or a different voltage (e.g., voltage multiplier, doubling circuits, transformer) as provided by the source (e.g., charges a capacitance) and provides energy from storage (e.g., discharges a capacitance) to form a current through a load as discussed above. The energy storage circuit may receive energy from an energy source in the form of pulses of energy.

An energy storage circuit may provide indicia of an amount of energy stored (e.g., a voltage across a capacitance). For example, storing energy in energy storage circuit 134 includes charging a capacitance. Releasing energy from energy storage circuit 134 includes discharging the capacitance. Energy storage circuit 134 provides indicia corresponding to the amount of energy presently stored. For example, signal V may provide to processor 114 at any time an indication of the extent (e.g., present amount) of stored energy. Signal V may correspond to a voltage across the capacitance discussed above. Signal V may also indicate the extent of an current delivery function (e.g., voltage across the capacitance at any time after discharging began).

Energy storage circuit 134 may include, for example one or more capacitors charged to the same or different voltages. Energy storage circuit 134 may further include one or more switches controlled by processor 114 for governing energy storage and/or release of stored energy. Energy storage circuit 134 may store energy for one pulse and release energy to form one pulse for delivery through a target. Energy storage circuit 134 may include circuits for storing and releasing energy for more than one pulse or discontinuously releasing energy for a series of pulses. Energy storage circuit 134 may include multiple capacitances, for example, one capacitance for each pulse of a series. Energy storage circuit 134 receives energy from energy source 132 and provides energy to current delivery circuit 136. Energy storage circuit 134 may provide indicia of stored charge to charge detector 184 (e.g., signal V as discussed above). Energy source 132 may delivery energy to energy storage circuit in the form of one or more pulses of energy. Each pulse of energy from energy source 132 tends to increase the energy stored in the energy storage circuit until the voltage of the capacitance reaches the voltage of the received energy pulses.

A current delivery circuit receives energy from an energy storage circuit and releases energy into a load (e.g., a target). An current delivery circuit of an apparatus provides energy for ionization and energy for delivery of a current through the load after ionization. Electrical energy is provided as a current having voltage. Current, of course, conveys charge. A current delivery circuit may provide indicia of current delivery through a load (e.g., measured current). A current delivery circuit may perform an energy conversion function. For example, receiving energy from an energy storage circuit may include converting the energy received to a different form (e.g., higher voltage). Energy for the current may be delivered at a voltage lower than a voltage sufficient for ionization. The source impedance of an current delivery circuit may be relatively high for delivery of energy for ionization and relatively low for delivery of energy for the current through the load after ionization. Current delivery (e.g., releasing energy) may include establishing a path for the delivery of energy to a load (e.g., ionizing air in a gap), detecting whether a load is present, and detecting whether a path is formed (e.g., detecting a relatively low path resistance). Providing or releasing energy from a capacitance may include discharging the capacitance into the load or into a circuit coupled to the load.

A current delivery circuit may perform the functions of initiating and aborting current delivery for ionization and/or delivery of the current. The functions of an current delivery circuit may be responsive to one or more control signals from a control circuit. For example, current delivery circuit 136 receives energy from energy storage circuit 134 and delivers energy to load 102 in response to control signals 164 from processor 114. If an attempt at ionization fails, energy for ionization and/or delivery of current may remain unused in energy storage circuit 134 and/or current delivery circuit 136; or be consumed in whole or in part by current delivery circuit 136. Preferably, if an attempt at ionization fails, most of the energy that would have been consumed if ionization was successful is conserved for a future attempt and substantially all of the energy for the current that would have been delivered after successful ionization is conserved for a future attempt.

In applications where a load is in series with an current delivery circuit, providing indicia of current delivery to the load may include providing indicia of a current in the series circuit. Providing indicia of current may include providing a proportional current that indicates an amount of current delivered to the load. A delivery circuit may distinguish between energy used for path formation (e.g., one or more arcs) and other energy delivered to a load.

For example, current delivery circuit 136 receives energy from energy storage circuit 134, provides energy to load 102, and provides indicia of current delivery to charge detector 184. Charge detector 184 may monitor a signal I for a period of time. Signal I indicates a current flowing in current delivery 112 for delivery to a load. By integrating signal I for the period of time, current delivery circuit 136 provides indicia of a quantity of charge delivered through the load. Current delivery 136 may include a step-up transformer for providing an ionization voltage for path formation. Path formation may occur across one or more gaps as discussed above.

A detector includes any circuit that provides status information to a control circuit. Status information may include indications of quantity, indications that a limit has been reached, or merely indicia that status has changed (e.g., where processor 114 may adequately determine quantitative information based on prior control signals and/or elapsed time). For example, ionization detector 144 and charge detector 184 monitor pulse generator 146 to provide signals describing an amount of energy stored by energy storage circuit 134 and monitor current delivery circuit 136 to provide signals describing occurrence of ionization and/or delivery of a current to a load.

Monitoring an energy storage circuit may include monitoring a voltage of a capacitance. The energy stored in a capacitance is generally given by the expression $E=\frac{1}{2}CV^2$ where E is energy in joules, C is capacitance in farads, and V is the voltage across the capacitance in volts. The voltage across the capacitance is consequently an indication of an amount of energy stored. Further, a change in voltage across the capacitance corresponds to a change in stored energy. Charging refers to increasing the quantity of charge stored in a capacitance and as the quantity of charge increases, so does the voltage across the capacitance. Discharging refers to removing charge from a capacitance and as current is delivered, the integral of current gives the quantity of charge removed. For example, stored energy detector 138 may include a voltage divider and/or comparator that provides one or more logic signals to processor 114 when a voltage of a capacitance of energy storage circuit 134 exceeds one or more limits. Processor 114 may include an integral analog-to-digital converter that performs such a voltage monitoring function. When energy storage is a predictable function of elapsed time, processor 114 may interpret an output of timer 116 as an indication of stored energy and stored energy detector 138 may be omitted. Processor 114 may make an allowance for remaining battery capacity, battery temperature, and/or battery voltage when predicting such an elapsed time.

Since prior to ionization substantially no current flows in the load, detecting ionization may include detecting a current in the load and/or detecting discharge of a capacitance that provided a voltage for ionization. For example, when current delivery circuit includes a local gap in series with the ionizable path of load 102, ionization of the path and the local gap may be simultaneous. Consequently, detecting ionization of the local gap may serve as a proxy for detecting ionization of the path in load 102. The local gap may radiate light, heat, or radio frequency signals that may be basis for detecting ionization. The local gap may complete a circuit (e.g., operate as a switch) for current flow or provide a voltage so that detecting the current flow or voltage may indicate ionization has occurred. For example, ionization detector 140 may include a voltage divider and/or comparator that provides a logic signal to processor 114 when a voltage of a capacitance of energy storage circuit 134 that provides energy for ionization is being discharged or was discharged. When stored energy detector 138 and ionization detector 140 monitor one or more related capacitances, these two detector functions may be implemented with one circuit.

A charge detector indicates an amount of charge delivered through a load. The amount of charged delivered may be understood from analysis of signals provided to the charge detector. By detecting charge delivered, a system according to the present invention accounts for losses and variation discussed above. By accounting for losses and variations, a system according to the present invention produces in the target pulses having properties with less variation from prescribed pulse properties. Losses and variations may include losses in energy storage, current delivery circuit 136, path variability to the load, load variability, losses in a launch system if present, losses of energy from energy conversion from one form to another, imperfections in components, component property variations, transfer of energy from the system to the load, and/or variations in environmental conditions.

A charge detector may receive a signal indicating an amount of energy currently stored in an energy storage circuit. The charge detector may analyze the amount of energy stored before and after delivery to provide an indication of an amount of charge delivered through a load. A charge detector may integrate a voltage or a current for a period of time to detect an amount of charge delivered through a load. Integrating is preferred in applications where pulse shape varies.

For example, system 100 may include circuits with only signal I, only signal V, or both signals I and V. Charge detector 184 may monitor signal I for a period of time. Signal I indicates a current flowing in current delivery circuit 136 for delivery to a load. By integrating signal I for the period of time, charge detector 184 provides indicia of a charge delivered to a load. Charge detector 184 may receive a signal V. Signal V indicates an amount of energy presently stored by energy storage circuit 134. By subtracting energy stored after a charging step from stored energy remaining after a discharging step, charge detector 184 computes a difference in energy and relates the difference to charge delivered to a load.

Charge detector 184 may include a subtraction circuit that indicates the difference between energy stored in energy storage circuit 134 before delivery and energy remaining in energy storage circuit 134 after delivery. The subtraction circuit may include analog technology (e.g., sample-hold) and/or digital technology.

Charge detector 184 may include a shunt in series with load 102 for monitoring a current through the load (e.g. as a voltage across the shunt) and an integrator that outputs indicia of charge as an integral of a current through the shunt. Integration of the current (or voltage) may be performed over a period that includes a duration of time before, during, and/or after delivery of a current to load 102.

Processor 114 may perform one or more of the functions of charge detector 184 by incorporating suitable signal processing technology.

To conserve energy, losses may be minimized and efficiencies improved. Energy losses in circuitry of the type used in system 100 include energy converted to heat via electrical resistance in the circuitry. Inefficient magnetic coupling also leads to losses as energy is divided into reflected energy converted to heat in resistances of the circuitry and transferred energy that is transferred to the load. Losses and inefficiencies in circuitry of energy source 132 and pulse generator 146 tend to be proportional to the voltage of power supplied, stored, and delivered. Consequently, processor 114, according to various aspects of the present invention, controls signal generator 106 in a manner to deliver current to load 102 using signals having relatively lower voltages than used in the prior art.

System 100 may accomplish energy conservation automatically and in accordance with predetermined configuration controls as discussed above without a user interface. When user controls and/or displays are desired, system 100 may include a suitable user interface 108. A user interface may be implemented with any conventional input technology including manual switches, touch sensitive panels (e.g., displays), and/or proximity switches (e.g., presence of user identification enabling operation). A user interface may be implemented with any conventional output technology (herein generally referred to as a display) including vibration, audio tones, voice messaging, colored lighted indicators, text displays, and/or graphics displays. Input and/or output technology may be enhanced with hermetic sealing, low power technologies (e.g., reflective or refractive indicators), and/or electrical isolation (e.g., to increase safety in the presence of high voltage circuitry).

Controls of a user interface for an apparatus may provide signals to request status, change configuration of the apparatus, and/or initiate or terminate any system function. For example, controls 110 include a manually operated safety switch, a manually operated trigger switch, and a manually operated mode switch that provide signals to processor 114 for enabling a local stun function, enabling a remote stun function, and performing any conventional configuration management of an electronic weapon. Controls 110 includes trigger 184. Controls 110 may further include a conventional mechanical or electronic safety mechanism or switch.

A trigger receives an external input. An external input to a trigger may be provided by a user and/or a target. Trigger 184 provides indicia of a trigger pull to system 100. Responsive to the trigger, system 100 may, inter alia, initiate a launch as described herein, attempt ionization, deliver a pulse of current, and/or deliver a series of pulses of current. A trigger may provide a signal to the processor to start or continue the desired function. For example, trigger 184 includes any circuit having a detector (e.g., switch, trip wire, beam break, motion sensor, and vibration detector) for detecting an input from a user and for generating a signal received by processor 114. A trigger may initiate or control an adjusting function of system 100.

Displays of a user interface for an apparatus may provide information describing status and/or configuration of the apparatus. For example, displays 112 include light emitting diodes lit to describe remaining battery capacity and/or a "ready/not-ready condition" of the apparatus for performing an electronic weapon function. For instance, system 100 may be "ready" when the safety is "off" and sufficient battery capacity is available for a remote stun function.

System 100 may include a launcher or propellant (not shown). The launcher or propellant may propel all or a portion of system 100 toward a target (e.g., load). For example, a portion propelled toward a target may include an electrode and a conductive tether that couples the electrode to a delivery circuit retained with the launcher. The portion propelled may include a non-tethered (e.g., wireless) projectile comprising, all or portions of energy source 132, energy storage circuit 134, current delivery circuit 136, and/or charge detector 184. In the case of a wireless projectile, providing indicia of charge delivered through the load may include wireless communication of the indicia from the projectile to circuits retained with the launcher (e.g., a base portion (not shown) of system 100).

Methods performed by an apparatus according to various aspects of the present invention may result in efficient use of energy for ionization. Methods, according to various aspects of the present invention, may include determining a first quantity of energy of a first ionization, and attempting a second ionization with a second quantity of energy less than the first quantity of energy. By decreasing the quantity of energy used for successive ionizations, more efficient ionization is accomplished. As a further result, energy may be efficiently used for delivery of current through a load. Since energy used for ionization may cause current to flow through the load, current through the load may be reduced as a result of reducing the energy used for ionization.

Figure 2:
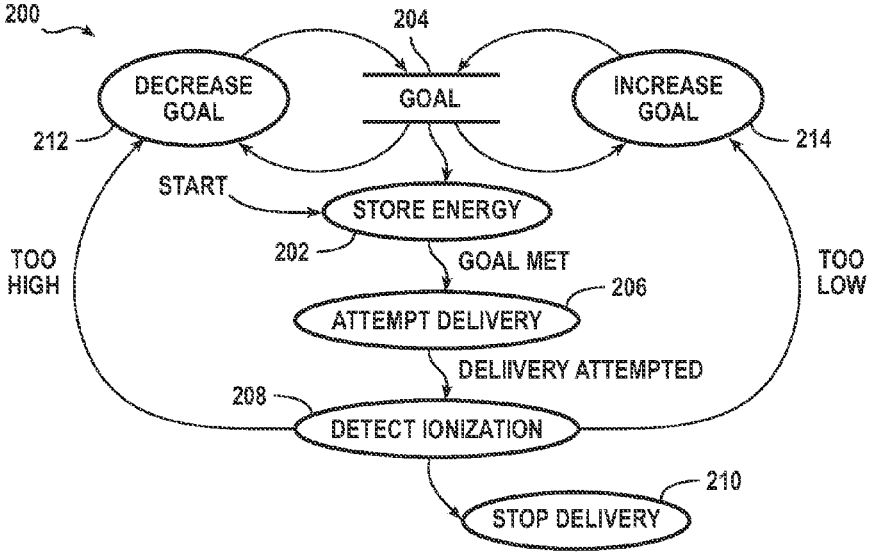
FIG. 2 is a data flow diagram of a method, according to various aspects of the present invention, for regulating arc energy.

For example, a method 200 of FIG. 2 is performed by processor 114 for efficient use of energy for ionization. Method 200 includes store energy process 202, attempt delivery process 206, detect ionization process 208, stop delivery process 210, decrease goal process 212, and increase goal process 214. Data stored in memory 118 and revised by operation of method 200 includes an ionization goal 204. Inter-process communication may be accomplished in any conventional manner (e.g., subroutine calls, pointers, stacks, common data areas, messages, interrupts). As desired, any of the processes of method 200 may be implemented in circuits of functional blocks other than control circuit 104.

Method 200 may be performed in a multitasking operating system environment where each process performs whenever sufficient input data is available. In other implementations, processes may be performed in a sequence similar to that described below. Multiple apparatus may be operated from one method if performed in an operating system environment that supports multithreaded execution (e.g., one thread, context, or partition for each apparatus). In the description below, method 200 controls signal generator 106 to output a series of pulses, each pulse requiring ionization of a path in load 102 of unknown characteristics. Unknown path characteristics may be encountered in an application of system 100 as an electronic weapon when electrode distance to the target is subject to change (e.g., electrodes lodged in clothing move with respect to target tissue as the target intentionally moves or falls).

Goal 204 may represent a numeric quantity of stored energy intended for an attempt at ionization. Goal 204 may be set to an initial value. The initial value may be a maximum value, a minimum value, or a mid-range value. For an apparatus that produces a series of pulses, it may be desirable to achieve ionization on the first pulse of the series. In such a case a maximum initial value is set. For an apparatus to achieve a particular quantity of successful ionizations per unit time (e.g., pulses per second) a mid-range value is set. For an apparatus to achieve maximum energy conservation (assuming failed attempts at ionization consume little or no energy), a minimum initial value is set. If failed attempts do consume energy, a mid-range value may be set to help avoid failed attempts. If an initial set of characteristics of the gap requiring ionization can be predicted, an initial value may be set in accordance with the initial set of characteristics.

Goal 204 may include representations of one or more numeric quantities of energy, capacitance, and/or voltage describing energy storage circuit 134; one or more numeric quantities of energy, pulse repetition rate, pulse magnitude, peak voltage, and/or peak current describing energy source 132; one or more numeric quantities describing voltage conversion by energy source 132, energy storage circuit 134, and/or current delivery circuit 136. Goal 204 may include configuration settings in lieu of any of the numeric quantities (e.g., for selection of capacitance, selection of transformer turns ratios, selection of limits for automatic switching, selection of pulse repetition rates).

Goal 204 may further include historical values of the goal used in any desirable number of prior attempts at ionization. By keeping historical values, decrease goal process 212 and/or increase goal process 214 may use binary search technology to establish a next goal. By keeping historical values, decrease goal process 212 and/or increase goal process 214 may provide hysteresis and/or margins to reduce undesirable goal changes.

On receipt of a start signal (e.g., trigger pull), store energy process 202 reads goal 204 and outputs control signals sufficient to store energy from energy source 132 in energy storage circuit 134 up to an amount of energy corresponding to goal 204. The goal energy may enable ionization. As discussed above, energy storage circuit 134 receives pulses that incrementally charge a capacitance up to a limit voltage. Energy storage circuit 134 may respond to controls from store energy process 202 to provide a desired capacitance in accordance with goal 204. Goal 204 may correspond to the limit voltage of the capacitance. The limit voltage may be achieved by a suitable quantity of pulses each pulse having the limit voltage as a peak voltage (e.g., energy source 132 provides output pulses of a programmable voltage magnitude). The suitable quantity may be determined by store energy process 202 as sufficient to effect an integer quantity of time constants (e.g., 5*RC) related to the capacitance being charged. The limit voltage may be achieved by a predicted quantity of pulses of a predetermined voltage magnitude (e.g., 200 pulses at a fixed peak voltage of about 2000 volts per pulse will charge the capacitance to about 1100 volts) according to a table (not shown) stored in memory 118. The limit may be achieved by continuing charging of the capacitance until indicia from stored energy detector 138 indicate to store process 202 that goal 204 has been met.

The goal energy may be sufficient in addition to enable delivery of a suitable current through load 102. An energy sufficient for current through the load may be independent of the characteristics of the ionizable path. Store energy process 202 may output controls sufficient to store energy for the current through load 102. Store energy process 202 may estimate a time suitable for meeting goal 204 and control storing of energy for both ionization and delivery of current so that goal 204 is met in about the same duration as needed to store energy sufficient for delivery of the current.

On indication that goal 204 has been met, attempt delivery process 206 may, immediately or after a suitable lapse of time, output control signals to current delivery circuit 136 to initiate an attempt to ionize the path of load 102. When delivery is automatic as discussed above, attempt delivery process 206 may be omitted.

After ionization has been attempted, detect ionization process 208 may read ionization detector 140 to determine whether the attempt succeeded or failed. For example, if ionization is not detected during a suitable period after an attempt was made, the attempt may be deemed a failed attempt. Generally, a failed attempt indicates that the energy and/or the voltage used to attempt ionization was less than necessary. A successful attempt may indicate that the energy and/or the voltage used to attempt ionization was either (a) sufficient; or (b) more than necessary. Detect ionization enables increase goal process 214 when the attempt failed; and otherwise enables decrease goal process 212.

Increase goal process 212 determines by how much the present goal should be increased to make ionization suitably likely to occur. The history of prior failed attempts, the goal for prior successful attempts, the number of successful attempts, and a required total quantity of successful ionizations in a period may be considered in determining whether: (a) a maximum energy should next be used for highly likely ionization; (b) a relatively large increase in energy should next be used to reduce a risk (or allow for the possibility) of one or more future failed attempts so as to likely meet the required total quantity of successful ionizations; or (c) a minimum increase in energy should next be used because there is still time to fail and still meet the required total quantity of successful ionizations. The determination of by how much to increase the present goal may be in accordance with a prescribed maximum energy budget per period, the cumulative energy spent in prior failed attempts at ionization during the period, and/or a predicted energy expense of failing the next attempt at ionization. In some applications, it may be reasonable to attempt ionization without change to the goal, for example, as limited by an intended hysteresis effect.

Decrease goal process 212 determines by how much the present goal should be decreased, if at all, so as to make ionization both likely to occur and as efficient as desired.

Increase goal process 214 and decrease process 212 read goal values from goal 204 and write goal values in goal 204. Written goal values may be substantially identical to existing goal values when the present goal value is not changed. By storing new values, a record of considering whether to increase or decrease the goal is made for reference in future performances of one or both of decrease goal process 212 and increase goal process 214.

When ionization is detected by process 208, stop delivery process 210 may reduce or quit discharging of a capacitance of store energy circuit 134. By reducing or quitting discharging, energy that would have been spent on successful ionization may be conserved. Conserved energy may be used to attempt a future ionization.

Figure 3A:
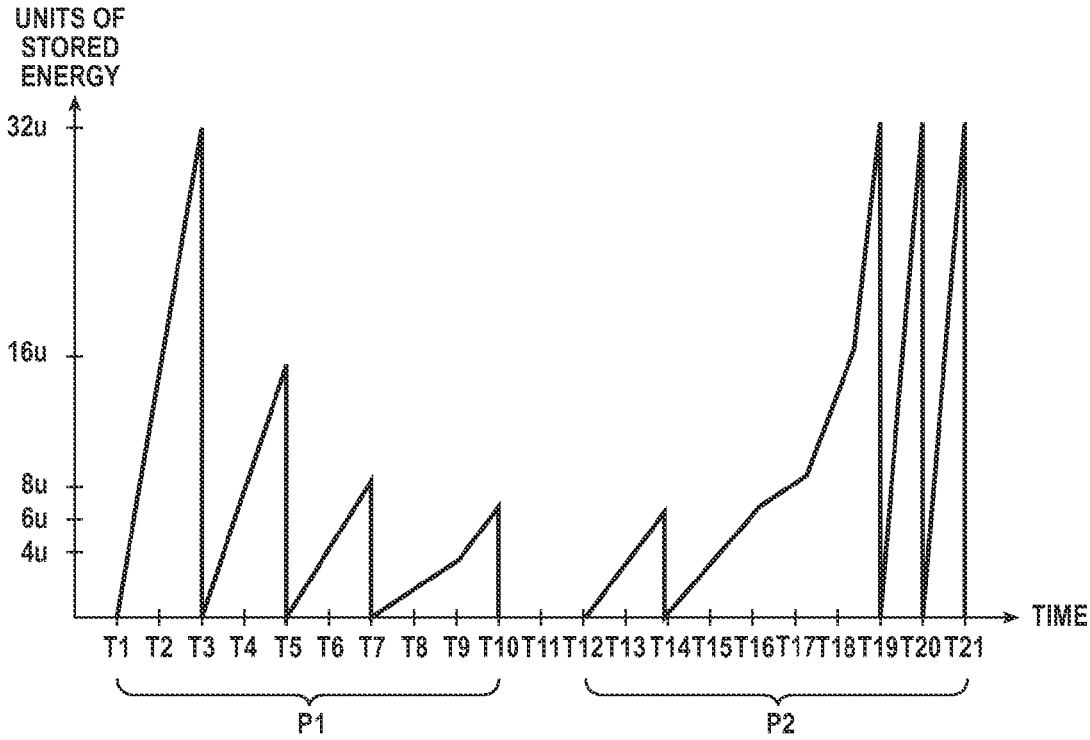
FIGS. 3A and 3B are graphs of energy versus time and detected ionization versus time for an example of operation of the apparatus of FIG. 1.
Figure 3B:
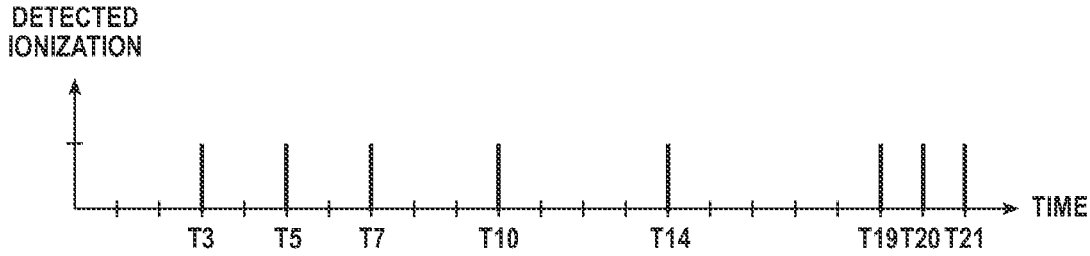

Operation of system 100 according to method 200 may result in a series of attempted ionizations in each of several succeeding periods. An example of such a series is shown in FIGS. 3A and 3B. In FIG. 3A, energy as accumulated in and removed from energy store circuit 134 is graphed versus time. Note that the charging rate varies depending on the starting and ending values of stored energy. Other implementations may use a constant charging rate. In the example of FIGS. 3A and 3B, system 100 is to give priority to providing 4 pulses per period. In the period P1 from time T1 to time T10 ionization is successful at times T3, T5, T7, and T11. Attempted ionization at time T9 fails.

Energy for successive attempts may be reduced in a binary search manner from an initial maximum value of 32 units which is successful at time T3. Decreasing uses an adjustment value initialized at 16 units. At time T5 an energy, reduced from 32 units to 16 units by the adjustment, accomplishes ionization. The adjustment is then halved. At time T7 an energy, reduced from 16 units to 8 units by the adjustment, accomplished ionization. The adjustment is then halved again. At time T9 an energy reduced from 8 units to 4 units by the adjustment is not sufficient for ionization. Energy is then increased by half the adjustment, that is 2 units, from 4 units to 6 units. The charging rate is doubled from time T9 to time T10 in an effort to complete the fourth pulse in period P1. Ionization is successful at time T10 with an energy of 6 units. Note that the risk of failing ionization at 6 units may be 50%. In another implementation, an energy of 8 units is used at time T10 because 8 units was successful at time T7. In still another implementation, a maximum energy for system 100, that is 32 units in this example, is used at time T10 to assure that the fourth pulse is completed if possible during period P1. The path ionization characteristic could have changed to exceed the maximum capability of system 100.

At time T12 preparations are made to provide a first pulse of the second period P2. To conserve energy, the energy used in this attempt is the energy of the last successful attempt at time T10, that is 6 units. In this example, at time T16, energy of 6 units fails to achieve ionization. Energy for the next attempt at time T17 is increased to the last successful energy used, 8 units at time T7. The attempt fails. Energy for the next attempt at time T18 is increased to the next prior successful energy used, 16 units at time T5. The attempt also fails. With little time to spare, the remaining three pulses are accomplished using a maximum energy and maximum charging rate for system 100, that is 32 units at times T19, T20, and T21.

In an alternate implementation, increases in energy use the same adjustment used in decreasing energy. For instance, an adjustment of 2 units is used at time T17, the same adjustment as used at time T9. The adjustment is then doubled for each failure, that is increasing by 4 units to attempt 12 units at time T18; and by 8 units to attempt 20 units at time T19. Assuming ionization was successful at 20 units at time T19, no adjustment is needed and 20 units would be successful at times T20 and T21 expending less energy than illustrated for period P2.

In another method, according to various aspects of the present invention, changes in energy are made linearly instead of according to a binary search. For example, increase goal process 214 always adds a fixed adjustment to the present goal energy value to determine the next energy value for goal 204. Decrease goal process 212 subtracts a fixed adjustment from the present goal energy value to determine the next energy value for goal 204. Decrease goal process 212 may implement hysteresis to avoid excessive changes to goal 204 (e.g., toggling due to the ambiguity of whether ionization was (a) sufficient; or (b) more than necessary as discussed above).

Figure 4:
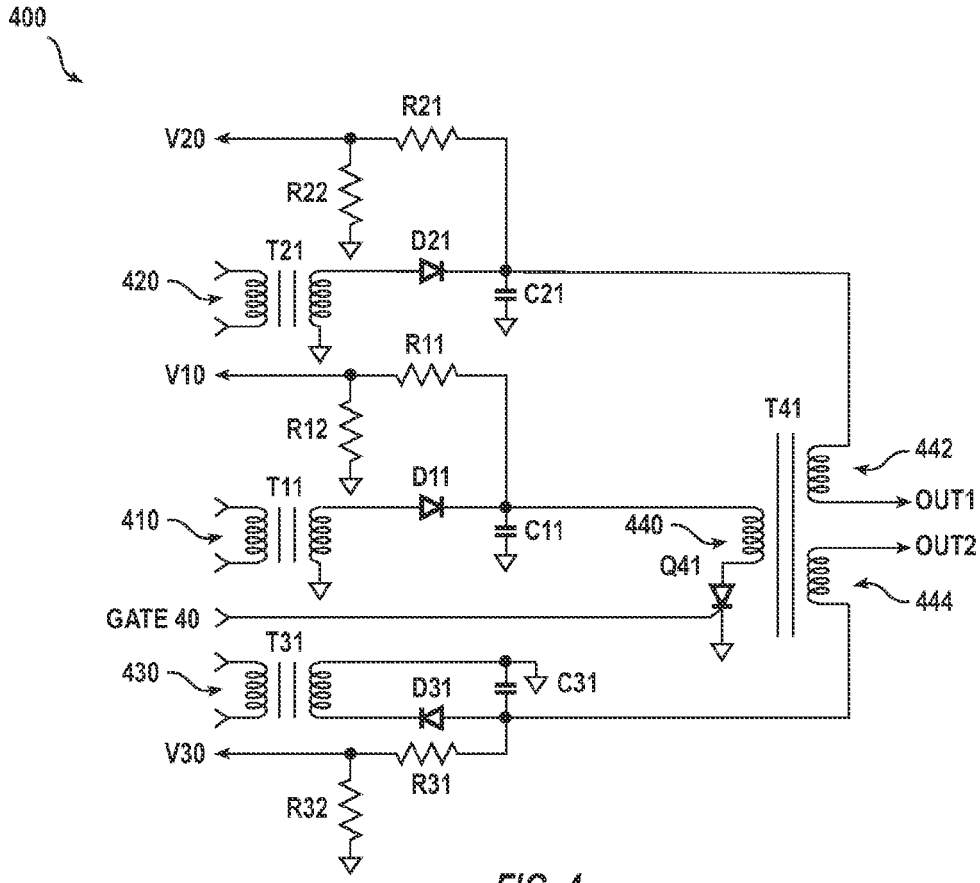
FIG. 4 is a schematic diagram of a pulse generator for an implementation of the apparatus of FIG. 1.

Implementations of the functions described above with reference to FIGS. 1 through 3 may include transformers for energy conversion (e.g., voltage step up), capacitors for energy storage (e.g., capacitors for energy for ionization and same or different capacitors for current or charge delivery), and switches (e.g., spark gap components, semiconductor switches, transistors (IGBJTs), rectifiers (SCRs)). For example, FIG. 4 presents a partial schematic diagram of circuit 400 for a system 100 that performs the functions of pulse generator 146 and detector 144.

Functions of current delivery circuit 136 are provided by SCR Q41, and transformer T41. Transformer T41 includes one primary winding 440 and two secondary windings 442 and 444. Winding 442 provides signal OUT1. Winding 444 provides signal OUT2. Load 102 having an ionizable path is coupled (e.g., via tether wires and electrodes) to circuit 400 output signals OUT1 and OUT2. The differential voltage of signals OUT1 and OUT2 communicates the energy for ionization and delivers the current through the load 102.

Circuit 400 includes an ionization energy store comprising transformer T11, diode D11, capacitor C11, resistors R11 and R12, transformer T41, and SCR Q41. Initially, capacitor C11 may have a negligible residual stored charge, and SCR Q11 is non-conducting. In operation, an energy source (not shown) provides a square wave signal (e.g., about 30 Hz, about 2000 volts peak) into primary winding 410 of transformer T11 for a period proportional to the desired energy to be stored in capacitor C11. Transformer T11 converts the square wave signal to a stepped up output signal (e.g., about 6000 volts). Diode Dll rectifies the stepped up output signal to produce pulses that incrementally charge capacitor C11 during the period. The voltage across capacitor C11 to ground is proportional to energy stored. A signal V10, available for monitoring by a processor (not shown) via a voltage divider formed of resistors R11 and R12, has a voltage proportional to the voltage across capacitor C11. Capacitor C11 holds the stored charge (e.g., maintains the voltage across C11) until signal GATE40 from the processor (not shown) fires SCR Q41. After firing SCR Q41, capacitor C11 discharges through primary winding 440 of transformer T41. Typically, capacitor C11 discharges completely without interruption (e.g., voltage across C11 goes from an initial maximum, due to stored charge, to zero). Transformer T41 converts the discharge energy of capacitor C11 by again stepping up the voltage for attempting ionization. The differential voltage between output signals OUT1 and OUT2 is a fixed multiple of the voltage in primary 440 which corresponds to the voltage across capacitor C11.

Ionization is detected by the voltage divider formed of resistors R11 and R12 that provides signal V10. The processor (not shown) analyzes signal V10. If voltage V10 soon after provision of signal GATE40 decreases below a limit voltage (e.g., about 1000 volts), then ionization is deemed to have occurred. Otherwise attempted ionization is deemed to have failed.

Two identical sub-circuits of circuit 400 store energy for providing the current through load 201. Each drive current energy store includes a transformer T21 (T31), a diode D21 (D31), a capacitor C21 (C31), and resistors R21 (R31) and R22 (R32). Initially, capacitor C21 (C31) may have a negligible residual stored charge. No power from these sub-circuits is transferred through transformer T41 until ionization occurs. In operation, an energy source (not shown) provides a square wave signal (e.g., about 30 Hz, about 2000 volts peak) into primary winding 420 (430) of transformer T21 (T31) for a period proportional to the desired energy to be stored in capacitor C21 (C31). Capacitors C21 and C31 may store any desired energy (e.g., equally or unequally). Transformer T21 (T31) converts the square wave signal to a stepped up output signal (e.g., about 6000 volts). Transformers T21 and T31 may have different turns ratios as desired. Diode D21 (D31)

rectifies the stepped up output signal to produce pulses that incrementally charge capacitor C21 (C31) during the period. The voltage across capacitor C21 (C31) to ground is proportional to energy stored. A signal V20 (V30), available for monitoring by a processor (not shown) via a voltage divider formed of resistors R21 (R31) and R22 (R32), has a voltage proportional to the voltage across capacitor C21 (C31). Capacitor C21 (C31) holds the stored charge (e.g., maintains the voltage across C21 (C31)) until ionization completes a circuit for discharging capacitor C21 (C31). After ionization, capacitor C21 (C31) discharges through secondary winding 442 (444) of transformer T41. Typically, capacitor C21 (C31) discharges completely without interruption (e.g., voltage across C21 (C31) goes from an initial maximum, due to stored charge, to zero). Transformer T41 does not perform a step up conversion function on the discharged energy of capacitor C21 (C31). The differential voltage between output signals OUT1 and OUT2 is approximately the differential voltage between capacitors C21 and C31. Because diodes D21 and D31 are in opposite polarities with respect to capacitors C21 and C31, these capacitors' voltages may be opposite (e.g., +6000 volts and −6000 volts respectively).

For system 100 implemented for operation as an electronic weapon, energy stored on capacitor C11 is in the range from 0.1 joule to 0.6 joule (C11 may be about 0.22 microfarads). Energy stored on capacitors C21 and C31 may be in sum 0.5 joule to 8.0 joule (C21 and C31 may be about 0.88 microfarads).

Figure 5:
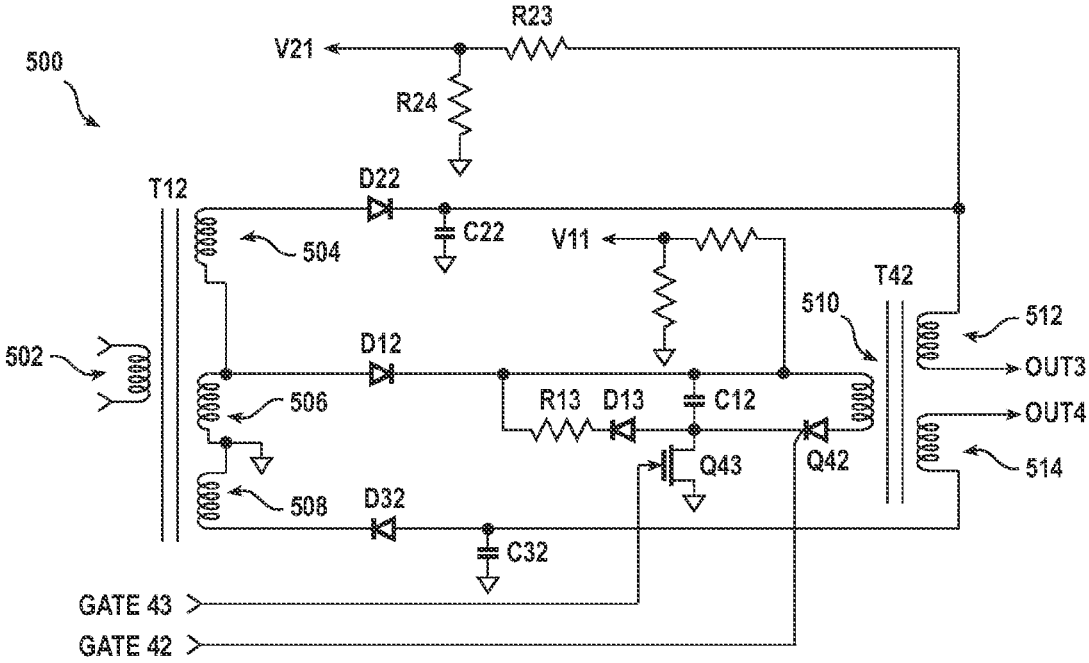
FIG. 5 is a schematic diagram of a pulse generator for another implementation of the apparatus of FIG. 1.

For another example, FIG. 5 presents a partial schematic diagram of circuit 500 for a system 100 that performs the functions of pulse generator 146 and detector 144.

Functions of current delivery circuit 136 are provided by SCR Q42, and transformer T42. Transformer T42 includes one primary winding 510 and two secondary windings 512 and 514. Winding 512 provides signal OUT3. Winding 514 provides signal OUT4. Load 102 having an ionizable path is coupled (e.g., via tether wires and electrodes) to circuit 500 output signals OUT3 and OUT4. The differential voltage of signals OUT3 and OUT4 communicates the energy for ionization and delivers the current through the load 102.

Circuit 500 includes an isolation energy store comprising winding 506 of transformer T12, diode D12, capacitor C12, snubber R13, D13 and SCR Q43. These components perform functions analogous to the isolation energy store of circuit 400 discussed above. In addition, the processor (not shown) provides signal GATE 43 to fire SCR Q43 to safely discharge capacitor C12 (e.g., responsive to the safety switch of user interface 108 indicating operation of system 100 is not desired).

Circuit 500 further includes two drive current energy store sub-circuits that each include a winding 504 (508) of transformer T12, a diode D22 (D32), a capacitor C22 (C32). Operation is analogous to the drive current energy store sub-circuits discussed above with reference to circuit 400.

In circuit 500, ionization is detected by the voltage divider formed of resistors R23 and R24 that provides signal V21. The processor (not shown) analyzes signal V21. If voltage V21 soon after provision of signal GATE42 decreases below a limit voltage (e.g., about 1000 volts), then ionization is deemed to have occurred. Otherwise attempted ionization is deemed to have failed. Voltage V21 directly indicates delivery of current through load 102. Since delivery cannot occur without a preceding ionization, voltage V21 is a reliable proxy (e.g., an indirect indicator) for directly detecting ionization (e.g., as in circuit 400).

After ionization is achieved, system 100 delivers a pulse or a series of pulses of current to a load (e.g., a target). Each pulse of current delivers an amount of charge through the load. System 100, according to various aspects of the present invention, may improve the uniformity of the amount of charge delivered by each pulse through a load.

In an application for delivery of non-uniform prescribed pulses, use of system 100 may decrease the error between prescribed delivery and actual delivery.

System 100 may improve uniformity of charge delivered or reduce error by, inter alia, monitoring charge delivered through the target by a present pulse of current, comparing the charge delivered by the present pulse to an effective amount (e.g., a goal amount) of charge, and adjusting the amount of charge to be delivered by a next pulse.

Monitoring an amount of charge may be accomplished as discussed above. Comparing the charge delivered to a stimulus goal amount may be accomplished in any manner including using a processor to compare the amount of charge delivered to a stimulus goal amount of charge. Adjusting may be performed in accordance with comparing to achieve uniformity of charge delivered or reduce error by each pulse.

A pulse that delivers charge to a target may have a path formation portion (e.g., ionization) and a stimulus portion (e.g., current delivery) as discussed above. The stimulus portion may have a shape prescribed as under damped, over damped, or critically damped. Delivered pulses may vary from the prescribed shape. Adjustment to achieve uniformity or reduce error of charge delivery may be achieved by adjusting primarily the stimulus portion of a pulse.

Figure 6:
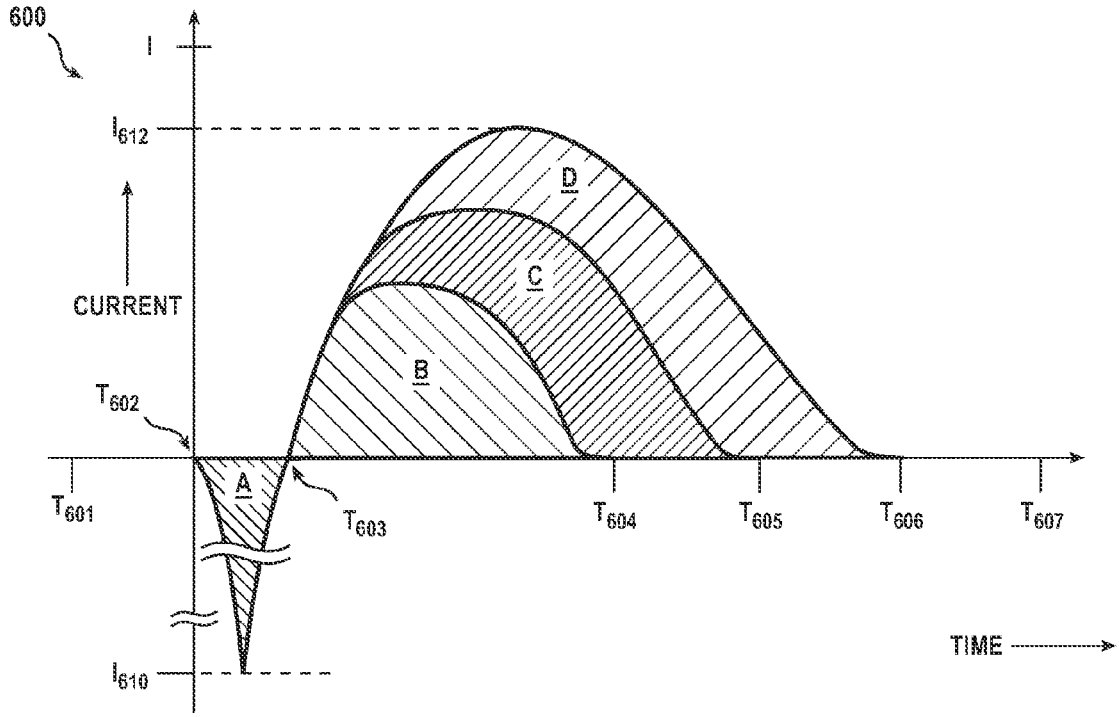
FIG. 6 is a graph of current versus time for different load conditions, according to various aspects of the present invention.
Figure 7:
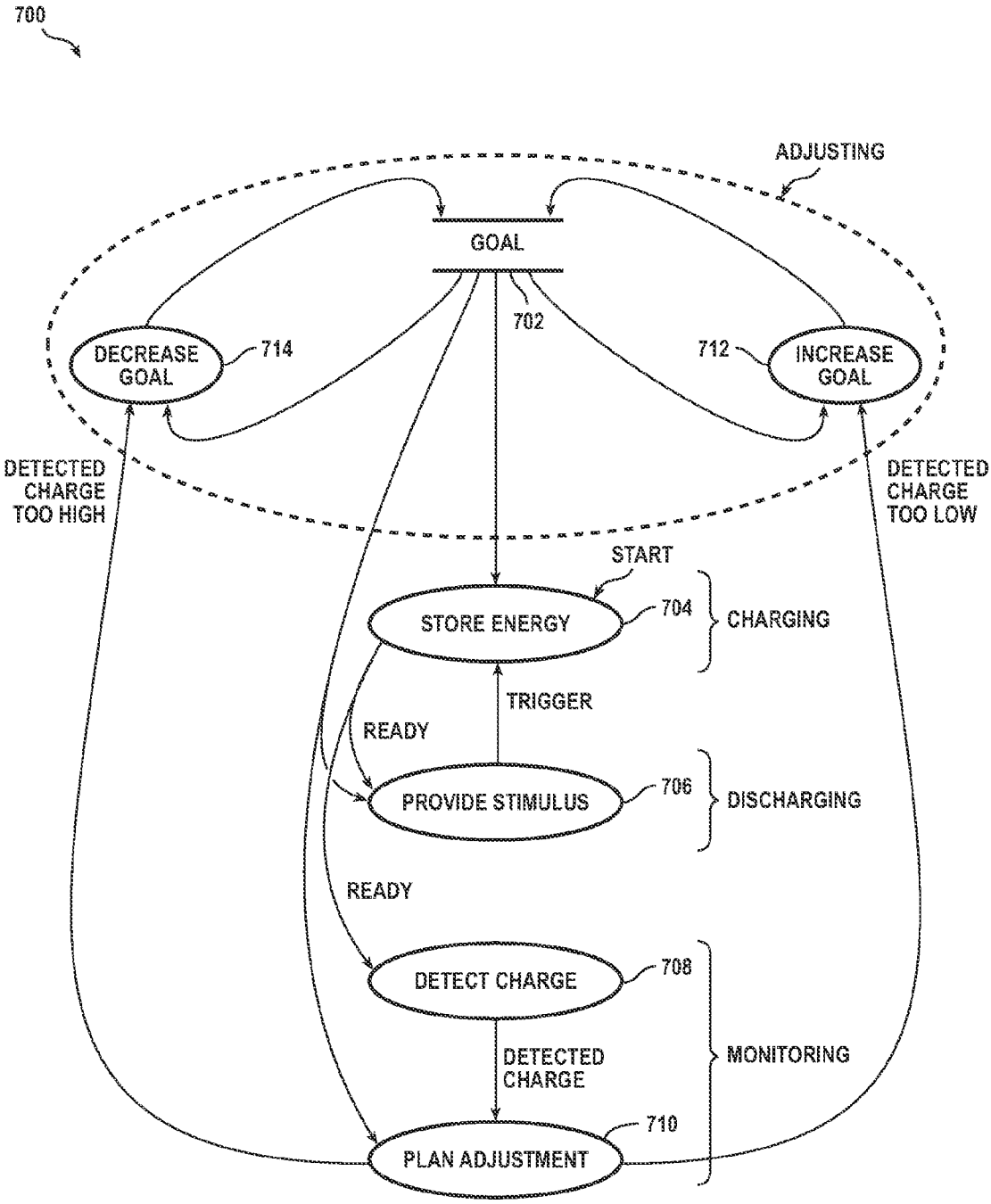
FIG. 7 is a data flow diagram of a method, according to various aspects of the present invention, for adjusting an amount of charge delivered through a load.
Figure 9:
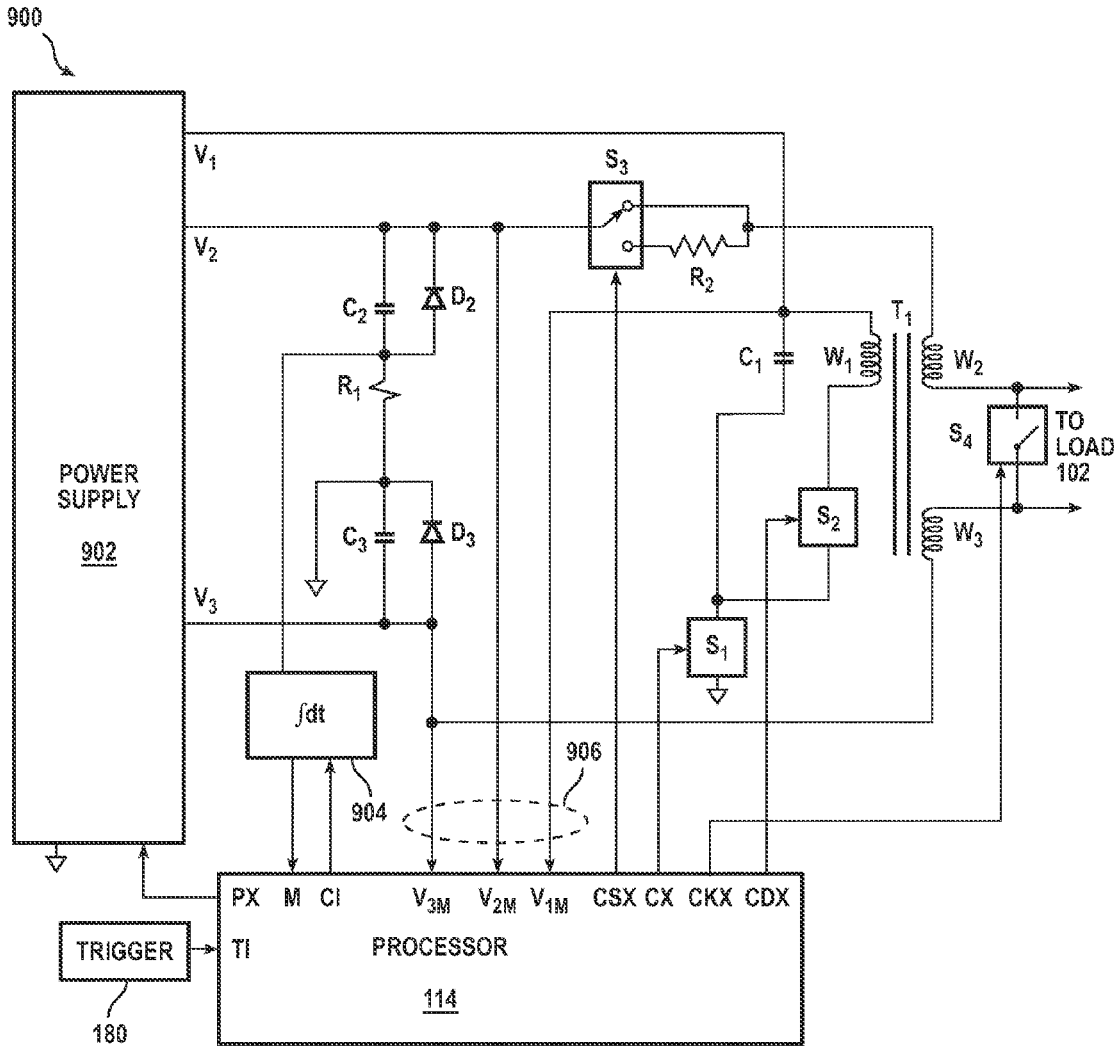
FIG. 9 is a schematic diagram of a circuit for another implementation of the apparatus of FIG. 1.

For example, FIG. 6 is a diagram of 3 pulses each having a path formation portion (A) and a stimulus portion (B, C, or D respectively). The 3 pulses are overlaid for comparison. In this example, the polarity of the path formation portion is the opposite polarity of the stimulus portion. Other polarities may be used. The stimulus portion corresponds to a critically damped pulse delivered from system 100 through load 102.

The y-axis of FIG. 6 represents current. Current 1610 represents the peak current of the path formation portion. Current 1612 represents the peak current of the stimulus portion. The absolute value of 1610 may be several orders of magnitude greater than the absolute value of 1612.

The x-axis of FIG. 6 represents time. Time T602 is an origin selected for convenience of discussion. Time T601 may correspond to a time when a trigger responds to an external input. Delivery of the path formation portion of each pulse begins at time T602 and continues until time T603. Time T603 corresponds to a start of stimulus delivery to a load. The duration of time from time T602 to time T603 may be less than about 1 microsecond for arcs of up to 2 inches (5 cm). An initial polarity reversal occurs at time T603. Times T604, T605, and T606 correspond to a time of delivery to a target of a suitable amount of stored charge (e.g., 95%).

Integration of each current pulse of FIG. 6 is indicated with cross-hatching. Integration determines the charge provided by the current for that portion of the pulse (e.g., path formation, stimulus, path formation and stimulus). For example, area A represents the integration of the current between time T602 and time T603 for a first pulse (all 3 pulses identical). Area A corresponds to an amount of charge delivered primarily during path formation. Areas B, C, and D correspond to the charge delivered from time T603 to time T604, from time T603 to time T605, and time T603 to time T606 respectively for each of the 3 pulses. Areas B, B+C, and B+C+D correspond to a respective amount of charge delivered for stimulus.

Integration may begin before time T602 and may continue after time T606 to include both a path formation and a stimulus portion of a current pulse. For example, integrating the current of FIG. 6 from time T601 to time T607 determines the charge provided for path formation and stimulus for each of the 3 pulses.

Area B represents an amount of charge delivered that is less than a desired and/or effective amount (e.g., goal amount) for a stimulus. Area B+C is an amount of charge delivered that is a desired and/or effective amount for stimulus. Area B+C+D is an amount of charge delivered that is more than a desired and/or effective amount for stimulus.

Delivery of an amount of charge per pulse greater than an effective amount (e.g., area B+C+D) represents a waste of the energy provided by energy source 132. Delivery of an amount of charge less than an effective amount (e.g., area B) represents an undesirable outcome. Delivery of an effective amount of charge (e.g., area B+C) for each pulse of current corresponds to delivery of a prescribed amount of charge.

An effective amount of charge per pulse may be designed to accomplish a desired result in the target or response by the target. For example, charge less than 50 microcoulombs may be effective for pain compliance. (e.g. with pulse width of about 4 to 8 microseconds). Charge less than 50 microcoulombs to about 250 microcoulombs, more (preferably from about 80 microcoulombs to about 150 microcoulombs) may be effective for halting voluntary locomotion (e.g., with pulse widths of about 9 microseconds to about 1000 microseconds).

Adjusting an amount of charge to be delivered by a next pulse compensates for the above mentioned variations and losses to provide more nearly a prescribed amount of charge (e.g., area B+C) in the next pulse. Adjustment may provide a prescribed amount of charge without change to the shape of the current pulse (e.g. under damped, critically damped, over damped).

Adjusting, according to various aspects of the present invention, may include compensating on a pulse by pulse basis. For example, adjusting may include detecting an amount of charge to be delivered by an immediately preceding pulse and adjusting the amount of charge to be delivered by a next pulse to compensate for expected deviation from a prescribed next pulse.

Adjusting may include providing a next pulse on the basis of a selected prior pulse, for example selected as being a member of a trend and/or as a worst case. Adjusting may include providing a next pulse on a basis of several prior pulses in any fashion (e.g., average, mean, median, moving average, filtered). Adjusting may include monitoring charge delivered by a present pulse and stopping delivery of the present pulse upon delivery of an effective amount of charge. Adjusting may be achieved, inter alia, by adjusting an amount of energy stored for a next pulse based on an amount of charge delivered to the load by a present pulse.

For example, when an amount of charge delivered by a present pulse was about a stimulus goal amount (e.g., area B+C), the amount of energy stored for a next pulse is not adjusted. When an amount of charge delivered by a present pulse is less than a stimulus goal amount (e.g., area B), an amount of energy stored for a next pulse is increased. When an amount of charge delivered by a present pulse is more than a stimulus goal amount (e.g., area B+C+D), an amount of energy stored for a next pulse is decreased.

Adjusting an amount of charge delivered may be achieved, inter alia, by changing a form or amount of the energy provided by an energy source, changing a form or amount of the energy stored by an energy storage circuit, and/or changing a form or amount of the energy provided by a current delivery circuit. A form of energy may be changed by changing a magnitude of a voltage, a magnitude of a current, an output impedance, a pulse duration, a magnitude of a pulse, a quantity of pulses, and/or a repetition rate of pulses.

For example, adjusting an amount of charge delivered may include changing an amount of energy provided by energy source 132 to energy storage circuit 134 (e.g., changing an amount of time that energy source 132 provides energy at a constant rate to energy storage circuit 134). If energy is delivered by energy source 132 to energy storage circuit 134 by pulses of energy, adjusting may include changing a quantity of pulses and/or a magnitude of pulses provided.

For example, adjusting an amount of charge delivered may include changing a conversion of energy at the input and/or output of energy storage circuit 134, an amount of energy stored (e.g., capacitance of capacitors, quantity of capacitance, extent of charging from energy source 132, and extent of discharging to current delivery circuit 136). If energy is delivered by energy storage circuit 134 to current delivery circuit 136 by pulses, adjusting may further include changing a quantity of pulses and/or a magnitude of pulses provided.

Storing energy in energy storage circuit 134 may include charging a capacitance to an adjusted stop voltage. Adjusting an amount of charge delivered may include discharging a capacitance to an adjusted stop voltage.

Adjusting an amount of charge delivered may include changing a duration of delivery of a current from current delivery circuit 136 (e.g., start or stop time that a switch is opened or closed), changing a voltage conversion (e.g., voltage multiplication), changing a duration of arc formation, changing a peak voltage of arc formation, changing a peak current delivered, and/or changing an impedance of a path of delivery to a load.

Methods performed by an apparatus according to various aspects of the present invention may provide, inter alia, prescribed pulses through a load (e.g., a target), assurance that recorded events are consistent, compensation for variations in component property values, compensation for variations in load, and/or conservation of energy (e.g., reduction of wasted energy) as discussed above. These methods according to various aspects of the present invention may refer to a stimulus goal. A stimulus goal comprises one or more values, as discussed above, for example, a limit (e.g., stop voltage, stop charge, stop duration, stop time). Such methods may further include recording a date and the in association with indicia of charge delivered.

A method for providing pulses, according to various aspects of the present invention, may make an adjustment for a next pulse based on charge delivered by an immediately preceding pulse. Such a method may be iterative. Such a method may begin its first iteration in response to a user control for arming the apparatus (e.g., a user moves a safety switch out of a safe position). The method may repeat for each pulse of a series of pulses (e.g., one iteration 10 to 40 times per second for 5 to 60 seconds). For each iteration adjustment may be made with reference to a stimulus goal. For each iteration, energy may be stored according to the adjusted goal. For example, method 700 of FIG. 7 includes store energy process 704, provide stimulus process 706, detect charge process 708, plan adjustment process 710, increase goal process 712, decrease goal process 714, and a stimulus goal 702.

Each process of method 700 may perform its function whenever sufficient input information is available. For example, processes may perform their functions serially, in parallel, simultaneously, or in an overlapping manner. An apparatus performing method 700 may implement one or more processes in any combination of programmed digital processors, logic circuits and/or analog control circuits. Interprocess communication may be accomplished in any conventional manner (e.g., subroutine calls, pointers, stacks, common data areas, messages, interrupts, asynchronous signals, synchronous signals). For example, method 700 may be performed by control circuit 104 that may control other functions of system 100 as discussed above. Data stored in memory 118 and revised by operation of method 700 may include goal 702 and may further include recorded information as discussed above (e.g., ionization energy and delivered charge).

Goal 702 may include a numeric value read and updated by method 700 to achieve prescribed (e.g., uniform) delivery of charge through a load. Goal 702 may represent a limit (e.g., a numeric quantity of, inter alia, stored energy intended for a stimulus portion of a next pulse) as discussed above. Goal 702 may be set to an initial value. The initial value may be a maximum value, a minimum value, or a mid-range value. Goal 702 may be set to account for expected losses as discussed above.

Goal 702 may include representations of one or more numeric quantities of energy, capacitance, and/or voltage describing energy storage circuit 134; one or more numeric quantities of energy, pulse repetition rate, pulse magnitude, peak voltage, and/or peak current describing energy source 132; and/or one or more quantities describing voltage conversion by energy source 108, energy storage circuit 134, and/or current delivery circuit 136. Goal 702 may include configuration settings in lieu of any of the numeric quantities (e.g., for selection of capacitance, selection of transformer turns ratio, selection of limits for automatic switching, selection of pulse repetition rates).

Goal 702 may further include a set of historical values and/or quantity of attempts used for any suitable quantity of prior attempts at providing a prescribed amount of charge. Increase goal process 712 and decrease goal process 714 may use historical values to, inter alia, perform a binary search to establish a next goal, to provide hysteresis, and/or to establish margins to reduce undesirable goal changes.

For a series of different prescribed pulses, goal 702 may include a corresponding series (or algorithm) of prescriptions. Further, one goal 702 may consist of a set of values describing several aspects of one prescription.

A memory may store one or more goals in any conventional manner. For example, memory 118 may store goal 204 and goal 702 in unique storage locations. In another implementation, information that may be considered part of goal 204 and/or goal 702 may be stored in one or more common locations. Storage of goal 204 and goal 702 may share a common format.

A store energy process includes any methods for storing energy. A store energy process may store energy for forming one or more pulses. For example, store energy process 704 stores energy for one pulse and indicates a ready condition. Goal 702 may correspond to a stop voltage at which energy source 132 stops providing energy to energy storage circuit 134. Process 704 may control storing of energy in a capacitance up to a stop voltage that corresponds to goal 702; accordingly, adjusting goal 702 changes the stop voltage. Process 704 may control storing of energy up to a stop voltage in a capacitance whose capacity corresponds to goal 702; accordingly adjusting goal 702 changes the capacity of the capacitance.

Store energy process 704 may control a charging function. For example, store energy process 704 may read goal 702 and control transfer of energy from energy source 132 to energy storage circuit 134 up to an amount of energy corresponding to goal 702. As discussed above, energy storage circuit 134 may receive pulses that incrementally charge a capacitance up to a stop voltage. Charging to the stop voltage may be achieved by a suitable quantity of pulses each pulse having the stop voltage as a peak voltage (e.g., energy source 132 provides output pulses of a programmable voltage magnitude).

As another example, energy storage circuit 134 may respond to controls from store energy process 704 to provide a desired capacitance in accordance with goal 702. Store energy process 704 may retain the stop voltage used prior to the change in capacitance. As discussed above, charging to the stop voltage may be achieved by a suitable quantity of pulses each pulse having the stop voltage as a peak voltage.

As another example, store energy process 704 may control coupling of an energy source to an energy store until a limit condition is reached. The limit condition may correspond to goal 702. The condition may be a goal amount of energy or a goal duration of charging.

Upon indication that goal 702 has been met, store energy process 704 may, provide a ready condition.

Store energy process 704 may begin in response to trigger 180 and/or in response to a "next" condition provided by provide stimulus process 706.

A provide stimulus process includes any method for delivering stimulus to a load to interfere with locomotion as discussed above. A provide stimulus process may include providing a stimulus signal as discussed above as one or more pulses. Such a process may further include launching and/or path formation. A provide stimulus process 706 may control a discharging function. For example, provide stimulus process 706 responds to the ready condition discussed above and begins delivery of energy stored by process 704 (e.g. after goal 702 is met). Process 706 may include discharging a capacitance of energy storage circuit 134 for delivery of a current to a load 102 by current delivery circuit 136. As discussed above, current may be delivered in one pulse for each ready condition. Process 706 may request storage of energy for another pulse by indicating a "next" condition to process 704.

A detect charge process includes any method for detecting an amount of charge delivered through a load (e.g., a target) and for providing, as a result, indicia of a quantity of charge. A detect charge process may detect an amount of charge by integrating a current and/or by subtracting voltages. For example, detect charge process 708 may begin integrating delivered current in response to the ready condition discussed above. Integration may continue for a predetermined duration. Integration may be discontinued if a result of integration is not changing more than a threshold amount per unit time. When integrating is discontinued or stopped, process 708 reports detected charge.

Detect charge process 708 may calculate charge using a subtraction of final conditions from initial conditions indicating discharging has occurred. As discussed above, a voltage across a capacitance may indicate the final and/or initial conditions.

A plan adjustment process includes any method for determining a difference between a result of detecting and a goal. If the difference is significant, adjusting the goal is desirable. The adjustment sign and amount may be based on the sign and magnitude of the difference. Such a process may determine a difference between the charge delivered by a pulse (or series of pulses) and a goal charge per pulse (or series of pulses). For example, plan adjustment process 710 determines by subtraction the difference between an amount of charge delivered by one pulse and a charge represented by goal 702.

A plan adjustment process may convert and/or scale the result and/or the goal to common units before subtracting. For example, plan adjustment process 710 may calculate charge from voltage (goal 702) using the expression $Q=(\frac{1}{2})CV^2$ where Q is charge, C is capacitance, and V is a stop voltage as discussed above. Plan adjustment process 710 may determine a difference between an amount of charge delivered and an effective amount of charge, while goal 702 may be expressed as an amount of energy stored for delivery.

A plan adjustment process identifies conditions. A plan adjustment process may identify conditions for a present pulse and plan an adjustment for a next pulse. For example, plan adjustment process 710 detects a no arc formed condition 802 (of table 800 of FIG. 8), an under goal condition 804, an at goal condition 806, and an over goal condition 808.

A no arc formed condition 802 occurs when path formation is not successful and stimulus cannot be delivered. Plan adjustment process 710 detects the no arc formed condition by detecting that an amount of current delivered is less than a threshold amount. In response to the no arc formed condition, plan adjustment process 710 may plan no change in the amount of stored energy for stimulus. In further response to the no arc formed condition, method 700 may adjust to a goal for path formation in a manner described above. By adjusting a goal for path formation, area A in FIG. 6 may change. Consequently, referring to FIG. 6, integration from time T602 to time T603 may indicate a different charge delivered. According to various aspects of the present invention, adjustment of charge stimulus may be responsive to a goal for path formation, a goal 702 for stimulus charge, and delivered charge (e.g., from time T601 to time T607).

An under goal condition 804 occurs when an amount of charge delivered to a load (e.g., FIG. 6 area B) is less than a desired amount. In response to the under goal condition, plan adjustment process 710 plans an increase in an amount of energy stored, to increase the amount of charge delivered to the load in a next pulse.

An at goal condition 806 occurs when an amount of charge delivered to a load (e.g., FIG. 6 area B+C) is about an effective amount of charge. In response to the at goal condition, plan adjustment process 710 plans storage of about the same amount of energy used for the present pulse for a next pulse (e.g., no change in goal 702).

An over goal condition 808 occurs when an amount of charge delivered to a load (e.g., FIG. 6 area B+C+D) is more than an effective amount of charge. In response to the over goal condition, plan adjustment process 710 plans a decrease in an amount of energy stored, to decrease the amount of charge delivered to the load in a next pulse.

Goal 702 at the first iteration of method 700 may effect storage of a maximum energy. In this case, plan adjustment process 710 in subsequent iterations for a series of pulses decreases the goal toward a desired goal value. The first pulses may be desired to be relatively maximum pulses.

Goal 702 at the first iteration of method 700 may effect storage of a minimum energy for energy conservation. Plan adjustment process 710 thereafter increases goal 702 toward a desired value for a series of pulses. Goal 702 may be set for a midrange value prior to the first iteration for unpredictable delivery conditions.

Table 800 proposes adjustments in an amount of energy stored that both increase and decrease the amount stored for a next pulse. Plan adjustment process 710 may propose not only a direction of energy storage change (e.g., increase, decrease, no change), but also an amount of energy storage change. An amount of change may be the same as the amount of a previous change or an amount that varies with each performance of plan adjustment process 710 (e.g., binary search). An amount of change may be determined by plan adjustment process 710, process 712, and/or process 714.

Detect charge process 708 and determine difference plan adjustment process 710 cooperate to perform a monitoring function. Monitoring may include using charge detector 184 and processor 114 to detect an amount of charge delivery through a load by current delivery circuit 136.

An increase goal process determines one or more values or sets of values for a goal (or set of goals) that correspond generally to an increase of a goal. For examples, process 712 modifies goal 702 responsive to plan adjustment process 710 determining that an amount of charge delivered is less than an effective amount. Process 712 may determine an amount of increase and/or implement an amount of increase proposed by plan adjustment process 710. As discussed above, an amount of increase may vary with each performance.

A decrease goal process determines one or more values or sets of values for a goal (or set of goals) that correspond generally to a decrease of a goal. For example, process 714 modifies goal 702 responsive to plan adjustment process 710 determining that an amount of charge delivered is more than an effective amount. Process 714 may determine an amount of decrease and/or implement an amount of decrease proposed by plan adjustment process 710. As discussed above, an amount of decrease may vary with each performance. Increase goal process 712 and decrease goal process 714, cooperate to perform an adjusting function.

Implementations of the functions described above with reference to FIGS. 1-9 may include a power supply for providing energy (e.g., programmable, switched-mode, battery), capacitors for storing energy (e.g., capacitors for path formation and/or stimulus), switches (e.g., spark gap components, semiconductor switches, transistors (IGBJTs), rectifiers (SCRs)), transformers for energy conversion (e.g., voltage step up), controllers for controlling processes, an integrator for detecting a charge, a shunt circuit for detecting a current provided through a load, and a trigger for initiating or continuing operation. For example, circuit 900 of FIG. 9 may be included in any apparatus for current delivery as discussed above.

Functions of energy source 132 are provided by power supply 902 and processor 114. Power supply 902 is a programmable power supply that charges path formation capacitor C1 and charges stimulus capacitors C2 and C3. Processor 114 controls charging by monitoring signals V1M, V2M, and V3M and directing Power supply 902 (e.g., via signal PX) to discontinue charging when a respective limit condition is reached (e.g., a stop voltage indicated by signal one or more of signals V1M, V2M, and V3M).

Functions of energy storage circuit 134 are provided by path formation capacitor C1, switches S1 and S2, stimulus capacitors C2 and C3, and processor 114. Processor 114 closes switch S1 and opens switch S2 to charge capacitor C1.

Before load 102 completes a circuit with the secondary windings W2 and W3 of transformer T1 (e.g., before an arc is formed to complete the circuit with or without a target), capacitors C2 and C3 may be charged.

Functions of current delivery circuit 136 are provided by transformer T1, switches S1 and S2, capacitors C1, C2, C3, diodes D2 and D3, and shunt resistor R1. Transformer T1 has one primary winding W1 and two secondary windings W2 and W3. After charging, capacitors C1, C2, and C3 and when a stimulus current is to be delivered, processor 114 opens switch S1 and closes switch S2 to start current flow from capacitor C1 into primary winding W1. Current in winding W1 induces a current in secondary windings W2 and W3 at a voltage sufficient to form an arc (e.g., ionize air in a gap) to establish a path through load 102 (e.g., a target). The arc permits current to discharge from capacitors C2 and C3 through load 102. Energy stored in capacitor C1 is released by discharging capacitor C1. A portion of the energy released is temporarily stored by transformer T1 as a magnetic field. After capacitor C1 substantially discharges, the magnetic field of transformer T1 collapses. The collapsing magnetic field releases this energy to continue the current through windings W2 and W3, load 102, D3, R1, and D2. Shunt resistor R1 is in series with the load. Diodes D2 and D3 provide a bypass circuit around capacitors C2 and C3 respectively, especially for conducting current continued by the collapsing magnetic field of secondary windings W2 and W3. Accordingly, the current that flows through the load also flows through resistor R1 providing a signal proportional to current for integration over time. Energy of the collapsing magnetic field (monitored by monitoring the current) consequently contributes to the charge delivered through the target.

Functions of charge detector 184 are provided by integrator 904, processor 114 and the series circuit through the target that includes, inter alia, resistor R1 and diodes D2 and D3. As discussed above, processor 114 may detect voltage values after a charging function and a discharging function for detecting an amount of current delivered. Doing so does not account for the substantial energy delivered by the collapsing magnetic field discussed above. Integrator 904 outputs indicia of an amount of charge delivered through load 102 to processor 114. Processor 114 controls operation of integrator 904 (e.g., via signal C1).

Processor 114 performs all function of processor 114 including method 700. Conventional signal conditioning circuitry (not shown) may scale signals 906.

Release of energy may be discontinued with reference to a goal (e.g., a goal referring to a prescribed amount of charge per pulse). Discontinuing release of energy consequently discontinues delivery of substantial charge through the target. Delivery may be discontinued by a processor and switches. For example, at any time, processor 114 in response to integrator 904 may determine that a goal amount of charge delivered through the target has been or will be exceeded (e.g., FIG. 6 at time T604 for reducing area D). Discontinuing may be accomplished by shunting the target (e.g., closing the normally open switch S4 of FIG. 9). Discontinuing may also be accomplished by mismatching the output impedance of a current delivery circuit and the target impedance. For example, processor 114 may add resistance in series with a secondary winding that is providing current through a target (e.g., by setting switch S3 to include resistor R2).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method performed by an apparatus, the apparatus for interfering with voluntary locomotion by a target by conducting a current through the target, the method comprising:

monitoring the current delivered through the target, the current delivered in accordance with a goal, wherein the current causes pain or skeletal muscle contractions that interfere with voluntary locomotion by the target; and adjusting the goal in response to a result of monitoring.

2. The method of claim 1 wherein monitoring comprises detecting whether ionization occurred and detecting a charge of the current.

3. The method of claim 2 further comprising recording indicia of a charge of the current in association with a time of day and a date.

4. The method of claim 2 further comprising recording indicia of energy stored in association with a time of day and a date.

5. The method of claim 2 further comprising recording indicia of energy released in association with a time of day and a date.

6. The method of claim 1 wherein monitoring comprises integrating the current over a period to detect whether ionization occurred and to detect a charge of the current.

7. The method of claim 1 wherein:

the goal comprises at least one of an ionization goal and a stimulus goal; and adjusting is performed in accordance with at least one of the ionization goal and the stimulus goal.

8. The method of claim 1 wherein:

the goal comprises at least one of an ionization goal and a stimulus goal; and adjusting comprises adjusting:

a stored energy for ionization in accordance with an ionization goal; and a stored energy for delivery of the current in accordance with a stimulus goal.

9. The method of claim 1 wherein:

the goal comprises at least one of an ionization goal and a stimulus goal; and adjusting comprises adjusting:

a released energy for ionization in accordance with an ionization goal; and a released energy for delivery of the current in accordance with a stimulus goal.

10. The method of claim 7, 8, or 9 wherein adjusting further comprises increasing at least one of the ionization goal and the stimulus goal.

11. The method of claim 7, 8, or 9 wherein adjusting further comprises decreasing at least one of the ionization goal and the stimulus goal.

12. The method of claim 7, 8, or 9 wherein at least one of the ionization goal and the stimulus goal comprises indicia of a quantity of pulses for storing the respective energy.

13. The method of claim 1 wherein:

the goal comprises at least one of an ionization goal and a stimulus goal; and adjusting comprises:

charging a first capacitance in accordance with the ionization goal; and charging a second capacitance in accordance with the stimulus goal.

14. The method of claim 1 wherein:

the goal comprises at least one of an ionization goal and a stimulus goal; and adjusting comprises diminishing delivery of the current in accordance with at least one of the ionization goal and the stimulus goal.

15. The method of claim 1 wherein the result comprises indicia of a quantity of charge delivered by the current.

16. The method of claim 1 wherein:

the current comprises a series of pulses; and adjusting comprises adjusting the goal for a next pulse of the series.

17. An apparatus for interfering with voluntary locomotion of a target by conducting a current through the target, the apparatus comprising:

a current delivery circuit that delivers the current in accordance with a goal for causing pain or skeletal muscle contractions that interfere with voluntary locomotion by the target;

a detector that detects the current delivered through the target to provide a result; and a processor that adjusts the goal in response to the result.

18. The apparatus of claim 17 wherein the detector detects whether ionization occurred and detects a charge of the current.

19. The apparatus of claim 17 wherein the detector integrates the current over a period to detect at least one of whether ionization occurred and a charge of the current.

20. The apparatus of claim 17 wherein:

the current delivery circuit comprises a capacitance having a voltage; and the detector detects a change of the voltage to detect at least one of whether ionization occurred and a charge of the current.

21. The apparatus of claim 17 wherein:

the goal comprises at least one of an ionization goal and a stimulus goal; and the processor adjusts the current in accordance with the goal.

22. The apparatus of claim 17 wherein:

the goal comprises at least one of an ionization goal and a stimulus goal; and the processor stores energy for ionization in accordance with the ionization goal and stores energy for delivery of the current in accordance with the stimulus goal.

23. The apparatus of claim 17 wherein:

the goal comprises at least one of an ionization goal and a stimulus goal; and the processor releases energy in accordance with at least one of the ionization goal and the stimulus goal.

24. The apparatus of claim 21, 22, or 23 wherein the processor increases at least one of the ionization goal and the stimulus goal.

25. The apparatus of claim 21, 22, or 23 wherein the processor decreases at least one of the ionization goal and the stimulus goal.

26. The apparatus of claim 21, 22, or 23 wherein at least one of the ionization goal and the stimulus goal comprises indicia of a quantity of pulses for storing the respective energy.

27. The apparatus of claim 17 wherein:

the goal comprises at least one of an ionization goal and a stimulus goal;

the currently delivery circuit comprises a first capacitance and a second capacitance; and to deliver the current in accordance with the goal, the processor directs charging of the first capacitance in accordance with the ionization goal and directs charging of the second capacitance in accordance with the stimulus goal.

28. The apparatus of claim 17 wherein to deliver the current in accordance with the goal, the processor diminishes delivery of the current in accordance the goal.

29. The apparatus of claim 17 wherein:

the current comprises a series of pulses; and the processor adjusts the goal for a next pulse in the series.

30. The apparatus of claim 17 wherein the result comprises indicia of a quantity of charge delivered by the current.

31. The apparatus of claim 17 wherein the result comprises indicia of whether ionization occurred.

32. An electronic control device comprising:

an energy delivery circuit that attempts delivery, in accordance with a goal, of an energy for ionization and that after ionization delivers a current for interfering with control by a human or animal target of skeletal muscles of the target;

an ionization detector that detects whether ionization occurred; and a processor that responsive to the ionization detector adjusts the goal to conserve energy expended for ionization.

33. The electronic control device of claim 32 wherein the goal comprises a value representing a quantity of stored energy.

34. The electronic control device of claim 32 wherein the goal comprises a value representing a quantity of capacitance for storing energy.

35. The electronic control device of claim 32 wherein the goal comprises a value representing a voltage corresponding to stored energy.

36. The electronic control device of claim 32 further comprising an energy storage circuit that stores, in accordance with the goal, the energy for ionization.

37. The electronic control device of claim 32 wherein the energy delivery circuit converts the energy for ionization in accordance with the goal.

38. The electronic control device of claim 32 wherein:

the goal comprises a configuration setting for an energy storage circuit that stores, in accordance with the goal, the energy for ionization; and the processor reconfigures the energy storage circuit in accordance with the configuration setting.

39. The electronic control device of claim 32 wherein the goal comprises a current value of the goal and a plurality of historical values of the goal, each historical value used in a prior attempted delivery.

40. The electronic control device of claim 32 wherein:

attempted delivery of the energy for ionization comprises discharging a capacitance having a voltage across the capacitance; and detecting whether ionization occurred comprises detecting that the voltage has changed.

41. The electronic control device of claim 32 wherein detecting whether ionization occurred comprises detecting delivery of the current.

42. The electronic control device of claim 32 wherein:

the current comprises a plurality of pulses; and delivering the current comprises delivering each pulse after a respective ionization.

43. The electronic control device of claim 32 wherein the processor adjusts the goal in response to detecting that ionization did not occur.

44. The electronic control device of claim 32 wherein the processor adjusts the goal in response to detecting that ionization did occur.

45. The electronic control device of claim 32 wherein the processor adjusts the goal to accomplish a linear change in a value of the goal.

46. The electronic control device of claim 32 wherein:

adjusting comprises changing a value of the goal in accordance with an adjustment amount; and adjusting further comprises changing the adjustment amount.

47. The electronic control device of claim 32 wherein:

the goal comprises a current value of the goal and a plurality of historical values of the goal, each historical value used in a prior attempted delivery;

adjusting the goal comprises changing the current value of the goal in accordance with an adjustment amount; and adjusting the goal further comprises changing the adjustment amount in accordance with an historical value of the plurality of historical values.

48. The electronic control device of claim 47 wherein changing the current value of the goal and changing the adjustment amount conform to binary searching.

49. The electronic control device of claim 32 wherein the energy delivery circuit stops delivery of the energy for the particular ionization after the ionization has occurred and before a total energy is expended that was available for delivery for the particular ionization.

* * * * *